United States Patent [19]

Kellogg et al.

[11] Patent Number: 4,930,390

[45] Date of Patent: Jun. 5, 1990

[54] AUTOMATIC MUSICAL PERFORMANCE APPARATUS HAVING SEPARATE LEVEL DATA STORAGE

[75] Inventors: Steven L. Kellogg; Jack A. Kellogg, both of Santa Cruz, Calif.

[73] Assignee: Yamaha Corporation, Hamamatsu, Japan

[21] Appl. No.: 300,115

[22] Filed: Jan. 19, 1989

[51] Int. Cl.[5] ..... G10H 1/06; G10H 1/42; G10H 1/46; G10H 7/00

[52] U.S. Cl. ..... 84/611; 84/622; 84/633; 84/DIG. 12

[58] Field of Search ..... 84/1.01, 1.03, 1.09–1.13, 84/1.19–1.24, 1.26–1.28, 115, 462, DIG. 7, DIG. 12, DIG. 29, 477 R, 478, 601, 602, 609≧614, 622–626, 633, 639–643

[56] References Cited

U.S. PATENT DOCUMENTS

| | | | |
|---|---|---|---|
| 3,955,459 | 5/1976 | Mochida et al. | 84/1.01 |
| 4,046,049 | 9/1977 | Luce et al. | 84/1.27 X |
| 4,305,319 | 12/1981 | Linn | 84/1.27 X |
| 4,469,000 | 9/1984 | Fujiwara et al. | 84/1.1 X |
| 4,694,724 | 9/1987 | Kikumoto et al. | 84/1.03 |
| 4,742,748 | 5/1988 | Tateishi | 84/1.03 |

*Primary Examiner*—Stanley J. Witkowski
*Attorney, Agent, or Firm*—Spensley Horn Jubas & Lubitz

[57] ABSTRACT

An automatic musical performance apparatus comprising two groups of tracks: one for storing pattern data of musical performance, the other for storing level data that modify the volume of tones produced on the basis of the pattern data, so that tone volume of each track can be altered while listening to the tone being reproduced. Tone volume varies depending on volume control and key-velocity. One of these can be selected to be modified by the level data, thus causing different effect on tone volume control. There are three kinds of level data: track, group, and total. Track level data modify each track data in the pattern data, each set of group level data modifies track data belonging to the same group, and the total level data uniformly modifies all track data. Using group level data facilitates the setting of level data. The pattern data can include a number track data having different loop length and rhythm style, thus enabling the automatic performance of polyrhythm style. The apparatus has a Next function whereby the tone colors of one or all tracks are changed immediately at a touch, or songs are consecutively played.

34 Claims, 21 Drawing Sheets

SONG PATTERN LOOP PATTERN = 16 BARS

| TRACKS | INSTR. | LOOP TRACK | TIME | REPETITION |
|---|---|---|---|---|
| TRACK1 | PIANO | 16 BARS | 4/4 | 1 |
| TRACK2 | TRUMPET | 8 | 4/4 | 2 |
| TRACK3 | TROMBONE | 4 | 4/4 | 4 |
| TRACK4 | SOLO VIOLIN | | | |
| TRACK5 | STRINGS | | | |
| TRACK6 | CONTRABASS | 2 | 3/4 | 11 (POLYRHYTHM) |
| TRACK7 | BASS DRUM | 2 | 4/4 | 8 |
| TRACK8 | SNARE DRUM | 2 | 4/4 | 8 |
| ⋮ | | | | |
| TRACK32 | | | | |

POLYRHYTHM

LEVEL TRACKS

TRACK1

TRACK2

⋮

TRACK32

GROUP1

⋮

GROUP4

TOTAL

PATTERN DATA

SONG DATA

LEVEL DATA

COMBINATION TBL

DSP 9
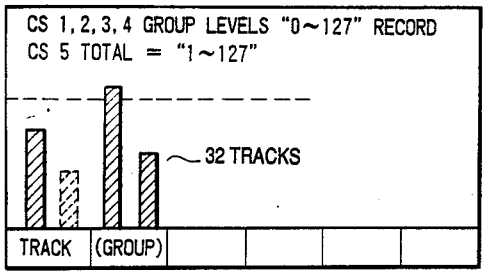
DSP 13
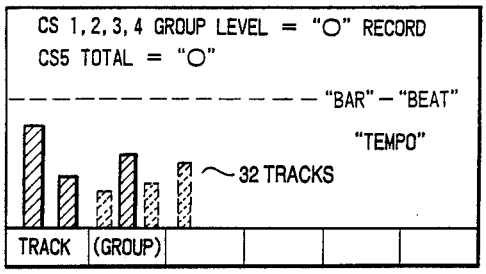
DSP 10
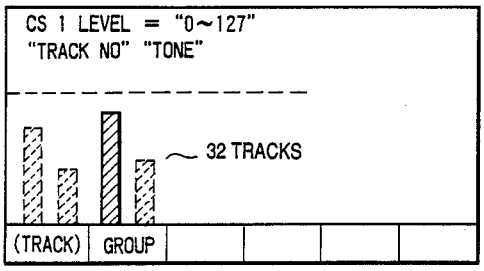
DSP 14
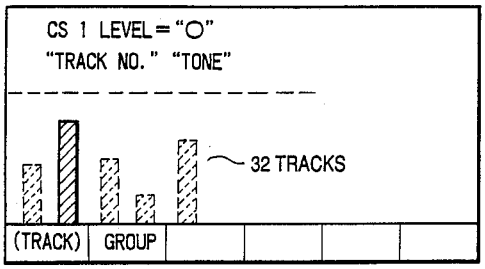
DSP11
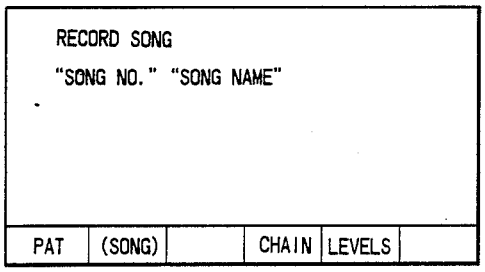
DSP15
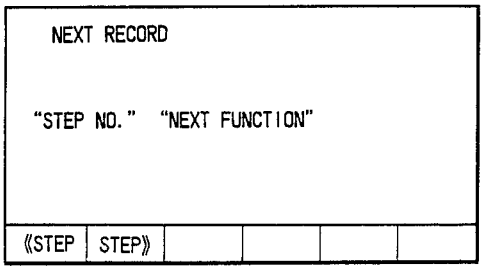
DSP 12
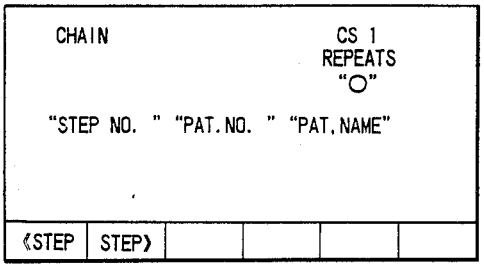
FIG.7B

```
DSP1 ──┬─(DIR on)──────── DSP2
       ├─(REC on)──────── DSP3
       ├─(Next on)─────── next NEXT Data load
       └─(NextR on)────── DSP15

DSP2 ──┬─(OK on)──────── DSP1          Song No change using CURSOR
       ├─( 1/4  or T.KEY)─CURSOR move  Song No select
       └─(Name on)─────── Song Name change using CURSOR

DSP3 ──┬─(PAT on)──────── DSP4
       ├─(Song on)─────── DSP11
       └─(EXIT on)─────── DSP1

DSP4 ──┬─(OK on)──────── DSP5
       ├─(Song on)─────── DSP11
       ├─(Name on)─────── Pat. Name setting using CURSOR
       ├─( 1/4  or T.KEY) CURSOR move    Pat. No. selection
       └─(EXIT on) ────── DSP3

DSP5 ──┬─(START on)────── DSP6
       ├─(CS1 move)────── Level Type setting (Vol/Vel)
       ├─(CS2 move)────── Level Scale setting (0 - 127)
       ├─(CS3 move)────── Group setting (0, 1 - 4)
       ├─(S1 - S32 on)─── Track No. setting (1 - 32)
       ├─(Timing on)───── DSP7
       ├─(Loop on)─────── DSP8
       ├─(Level on)────── DSP9
       └─(EXIT on) ────── DSP3

DSP6 ──┬─(STOP on)─────── DSP5
       └─(Level on)────── DSP9

DSP7 ──┬─(START on)────── DSP6
       ├─(CS1 move)────── Track Loop Beat setting (1 - 99)
       ├─(CS2 move)────── Track Loop Denom. setting (2, 4, 8,16,32)
       ├─(CS3 move)────── Pattern Loop Beat setting (1 - 99)
       ├─(CS4 move)────── Pattern Loop denom. setting (2,4,8,16,32)
       ├─(Loop on)─────── DSP8
       ├─(Level on)────── DSP9
       └─(EXIT on)─────── DSP5

DSP8 ──┬─(CS1 move)────── Track Loop Bar setting (0, 1 - 128)
       ├─(CS2 move)────── Pattern Loop Bar setting (1 - 128)
       ├─(Timing on)───── DSP7
       ├─(Level on)────── DSP9
       └─(EXIT on)─────── DSP5
```

FIG. 8 A

```
DSP9 ──┬─(Track on)──── DSP10
       ├─(START on)──── Recording start (Pattern)
       ├─(STOP on)──── Recording stop  (Pattern)
       ├─(CS1-4 move)── Group Level data setting (0 - 127)
       ├─(CS5 move)──── Total Level data setting (0 - 127)
       └─(EXIT on)──── DSP6

DSP10 ─┬─(Group on)──── DSP9
       ├─(START on)──── Recording start (Pattern)
       ├─(STOP on)──── Recording stop  (Pattern)
       ├─(CS1 move)──── Track Level data setting (0 - 127)
       ├─(S1-S32 on)── Track No. setting (1 - 32)
       └─(EXIT on)──── DSP6

DSP11 ─┬─(PAT on)──── DSP4
       ├─(Chain on)──── DSP12
       ├─(Level on)──── DSP13
       └─(START on)──── Song and Level Play start

DSP12 ─┬─(<<Step on)── Step No.-1
       ├─(Step>> on)── Step No.+1
       ├─(CS1 move)──── Repetition Times setting (1 - 99)
       ├─( 1/1  or T.KEY)-Pattern No. selection (1 - 99)
       └─(EXIT on)──── DSP11

DSP13 ─┬─(Track on)──── DSP14
       ├─(START on)──── Recording start (Levels)
       ├─(STOP on)──── Recording stop  (Levels)
       ├─(CS1-4 move)── Group Level data setting (0 - 127)
       ├─(CS5 move)──── Total Level data setting (0 - 127)
       └─(EXIT on)──── DSP11

DSP14 ─┬─(Group on)──── DSP13
       ├─(START on)──── Recording start (Levels)
       ├─(STOP on)──── Recording stop  (Levels)
       ├─(CS1 move)──── Track Level data setting (0 - 127)
       ├─(S1-S32 on)── Track No. setting (1 - 32)
       └─(EXIT on)──── DSP11

DSP15 ─┬─(<<Step on)── NXT.P-1
       ├─(Step>> on)── NXT.P+1
       ├─(S1-S32 on)── Track No. setting (1 - 32)
       ├─(CS1 move)──── Tone-Color No. setting
       ├─(CS2 move)──── Combination No. setting
       ├─(CS3 move)──── Sequence No. setting
       └─(EXIT on) ──── DSP1
```

FIG. 8B

PATTERN RECORD
(DSP 6)

SONG RECORD
(DSP 12)

SONG PLAY AND LEVEL RECORD(1)
(DSP13:GROUP LEVEL AND TOTAL LEVEL)

EVENT READ

LEVEL CONTROL

SONG PLAY AND LEVEL RECORD ( 2 )
(DSP 14: TRACK LEVEL)

AUTOMATIC MUSICAL PERFORMANCE APPARATUS HAVING SEPARATE LEVEL DATA STORAGE

BACKGROUND OF THE INVENTION

1. Field of the Invention

This invention relates generally to automatic musical performance apparatuses for recording musical performance data onto a recording medium and replaying the musical performance data therefrom, and more particularly, to an automatic musical performance apparatus having two groups of tracks, a first group for recording musical pattern data such as keycode, key-velocity and duration, and a second group for recording level data for each track of the first group.

2. Prior Art

Heretofore, automatic musical performance apparatuses which allow the user to record their performances and replay them are widely known. For example, U.S. Pat. No. 3,955,459 discloses an automatic performance system in an electronic musical instrument in which all of the performance information on tone pitches, tempos, colors, volumes, vibrato effect and the like which are obtained from movable members such as a keyboard, tone levers, an expression pedal, and a vibrato switch operated by a performer during a performance, can be automatically reproduced with high fidelity and modified as desired.

The apparatus, however, has some problems to be solved, as follows:

(a) When recording musical tones, it is difficult for a performer to know the differences in tone volume among tracks. It is far easier for a performer to adjust the tone volume of each track by replaying the performance and listening thereto The conventional apparatus, however, is not provided with a function for controlling the volume of each track after recording by listening to the replay of the performance.

(b) Tone volume varies in a different manner whether it is controlled in accordance with volume information or key-velocity information: whereas the volume information simply varies tone volumes, the key-velocity information presents small tone color changes as well as tone volume variation The conventional apparatus is not provided with a means for selecting either key-sensitive volume control or simple volume control, and hence does not allow satisfactory volume control.

(c) Suppose that a second group of tracks is provided for controlling volume of each track in a first group of tracks that contain pattern data. If all volume data of each track in the second group must be set, the setting work will be tedious and time consuming.

(d) A modern musical piece often includes parts whose time or rhythm style are different from one another (polyrhythm), and also includes repetition patterns of different loop lengths. The conventional apparatus, however, is not capable of handling these different rhythms and loop lengths.

(e) Conventional apparatuses have a Next function that changes a song number or tone color sequentially. But the conventional Next function cannot change a set of data such as a combination of tone colors of tracks, a combination of a song and tone color thereof, etc.

SUMMARY OF THE INVENTION

It is therefore an object of the invention to provide an automatic musical performance apparatus having a first group of tracks that store pattern data such as keycode data, duration data thereof, and key-velocity data; and a second group of tracks that store level data for each track of the first group. This makes it possible for a performer to set and change level data in the second group while listening to patterns in the first group during playback.

Another object of the invention is to provide an automatic musical performance apparatus that allows the user to select either volume data or velocity data as the data to be modified by the level data.

A further object of the invention is to provide an automatic musical performance apparatus in which the setting of volume control parameters is easily achieved. To meet the requirement, tracks for level control are divided into several groups, for example, a group including all tracks for string instruments, a group containing all tracks for rhythm sections, etc., and common volume data is assigned to each tracks of the same group A still further object of the invention is to provide an automatic musical performance apparatus wherein loop points of repetition phrases are independently set at each track, hence enabling a polyrhythm performance.

A further object of the invention is to provide an automatic musical performance apparatus having a Next function whereby combinations of different control parameters (a song and its tone color, for example) can be sequentially changed at a touch.

In a first aspect of the present invention, there is provided an automatic musical performance apparatus comprising:

primary memory means having a plurality of tracks containing pattern data;

secondary memory means having a plurality of tracks containing level data indicative of tone volumes of the tracks of the primary memory means;

data read means for reading data in the tracks of primary and secondary memory means;

tone generating means for generating musical tones in accordance with data supplied from the data read means; and volume control means for controlling tone volumes of the tone generating means according to the level data.

In a second aspect of the present invention, there is provided an automatic musical performance apparatus comprising:

primary memory means having a plurality of tracks containing pattern data having level scale data and velocity data, the level scale data indicating tone volume of the pattern data, the velocity data indicating key velocity of each tone in the pattern data;

secondary memory means having a plurality of tracks containing level data indicative of tone volumes of the tracks of the primary memory means;

selecting means for selecting either the level scale data or velocity data as selected data to be controlled by the level data, according to vol/vel data included in each track in the primary memory;

data read means for reading data in the tracks of primary and secondary memory means;

tone generating means for generating musical tones in accordance with data supplied from the data read means; and volume control means for controlling tone volumes of the tone generating means according to the selected data modified by the level data.

In a third aspect of the present invention, there is provided an automatic musical performance apparatus comprising:

primary memory means having a plurality of tracks containing pattern data;

designating means for dividing the tracks into one or more groups and assigning identical group level data to the tracks in the same group;

group level data memory means for storing the group level data;

data read means for reading data in the tracks of primary memory means and the group level data in the group level data memory means;

tone generating means for generating musical tones in accordance with data supplied from the data read means; and volume control means for controlling tone volumes of the tone generating means according to weight data obtained from the group level data.

In a fourth aspect of the present invention, there is provided an automatic musical performance apparatus comprising:

primary memory means having a plurality of tracks containing pattern data, the pattern data include track data having different loop lengths and/or rhythm parameters depending on tracks, the track data being repeated with the loop length;

song data memory means for storing song data indicating a sequence and repetition times of the pattern data;

data read means for reading the pattern data in each track independently of the other tracks according to the song data; and tone generating means for generating musical tones in accordance with data supplied from the data read means.

In a fifth aspect of the present invention, there is provided an automatic musical performance apparatus comprising:

primary memory means having a plurality of tracks containing pattern data;

song data memory means for storing song data indicating a sequence and repetition times of the pattern data, next data memory means for storing next data relating to next playback of the pattern data according to the song data;

switching means for switching the next data;

data read means for reading the pattern data according to the song data;

tone generating means for generating musical tones in accordance with data supplied from the data read means; and control means for controlling the data read means and/or the tone generating means according to the next data chosen by the switching means.

BRIEF DESCRIPTION OF THE DRAWINGS

FIG. 7A and 7B are pictorial views showing displays on the screen of LCD 2;

FIGS. 8A and 8B are diagrams showing display numbers and relationships between switch operation and the results thereof;

DESCRIPTION OF THE PREFERRED EMBODIMENTS

The invention will now be described with reference to the accompanying drawings.

[CONSTRUCTION OF KEYBOARD PORTION]

Figure 1:
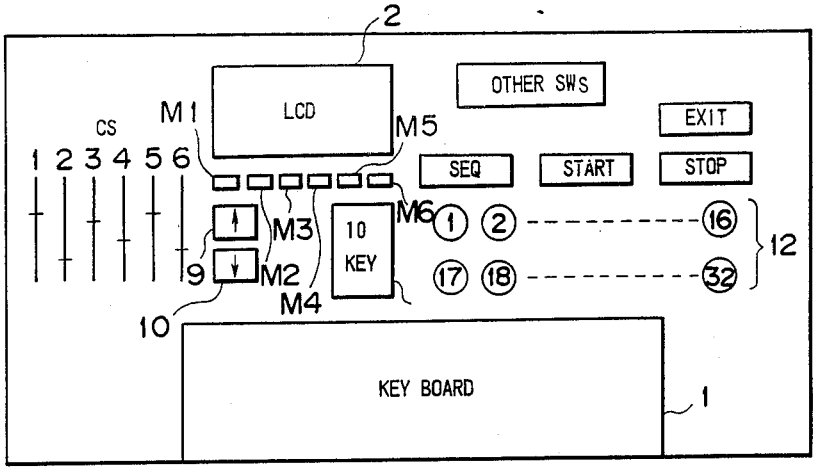
FIG. 1 is a plan view of a keyboard portion of a sequencer (automatic musical performance apparatus) according to an embodiment of the present invention.

FIG. 1 is a plan view of a keyboard portion of a sequencer (automatic musical performance apparatus) according to the present invention. In FIG. 1, numeral 1 designates a keyboard comprising white keys and black keys. Each key is provided with two switches thereunder to detect key operation: a first and a second key-switches. The first key-switch turns on at the beginning of a key depression, whereas the second key-switch turns on near the end of the key depression. Characters CS1 to CS6 denote continuous sliders (variable resistors) whose resistances vary by manual operations of levers thereof. Numeral 2 designates a liquid crystal display (LCD), and M1 to M6 denote multifunction switches of the push-button type. Each of the multifunction switches M1 to M6 has alternate functions, one of which is shown at the bottom of the LCD screen (see FIG. 7A and 7B). Numerals 9 and 10 designate cursor switches for moving a cursor displayed on the screen of LCD 2. Numeral 11 designates a ten-keypad, and 12 denotes track-selection switches. The track-selection switches 12, consisting of 32 switches, are provided for selecting record tracks described later. Twenty-six switches of these track-selection switches are also used as alphabet keys for entering data. SEQ, START, STOP, and EXIT designate function keys. Other switches such as the tone-color-selection switches, the effect-selection switches and the power switch, are not shown but are provided in the keyboard portion.

[ENTIRE CONSTRUCTION OF SEQUENCER]

Figure 2:
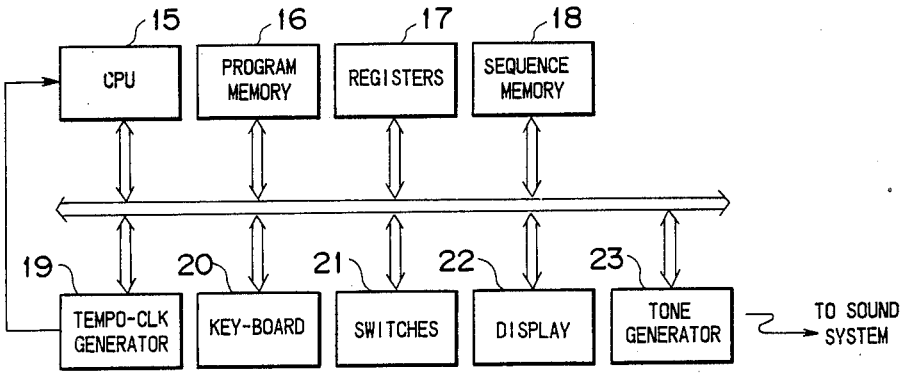
FIG. 2 is a block diagram showing the entire electrical construction of the sequencer.

FIG. 2 is a block diagram showing the entire electrical construction of the sequencer. The sequencer includes CPU (central processing unit) 15 that controls each portion thereof. The CPU 15 operates on the basis of programs stored in a ROM program memory 16. Numeral 17 designates a register block that includes various kinds of RAM registers. A sequence memory 18 is also RAM and stores performance data for automatic performance. A tempo-clock generator 19 generates a tempo clock TC that produces the tempo in an automatic performance. The tempo clock TC is transferred to the CPU 15 as an interrupt signal. A keyboard circuit 20 detects on/off of each key of the keyboard 1 on the basis of the on/off states of the first and second key-switches provided therewith. Also, it detects the time interval between on-timing of the first and second key-switches and computes key-velocity from this interval. Thus, it produces keycode KC of a depressed key and key-velocity KV thereof, and supplies them to a bus line B.

A switch circuit 21 detects each state of the multi-function switches M1 to M6, and continuous sliders CS1 to CS6 on the keyboard portion, thus supplying the detected result to the bus line B. A display circuit 22 drives the LCD 2 on the basis of display data provided through the bus line B. Tone generator 23 has 32 channels for producing 32 different musical tones simultaneously. The musical tone signals produced are supplied to a sound system where they are produced as musical tones.

[AUTOMATIC PERFORMANCE DATA]

Here, automatic performance data stored in the sequence memory 18 will be described. A main object of the sequencer is to achieve an automatic performance of an accompaniment. As is well known, there are many repetitions in accompaniments. In particular, in rhythm instruments, such as bass drums, most parts of a piece of music are repetitions of the same pattern. For this reason, in the sequencer of the embodiment, up to 99 repetition patterns (hereafter called Pattern data) are stored in the sequence memory 18, as well as Song data that indicate combinations of the Pattern data. During an automatic performance, the Pattern data are sequentially read out of the sequence memory 18 in accordance with the order indicated by the Song data.

Figure 3:
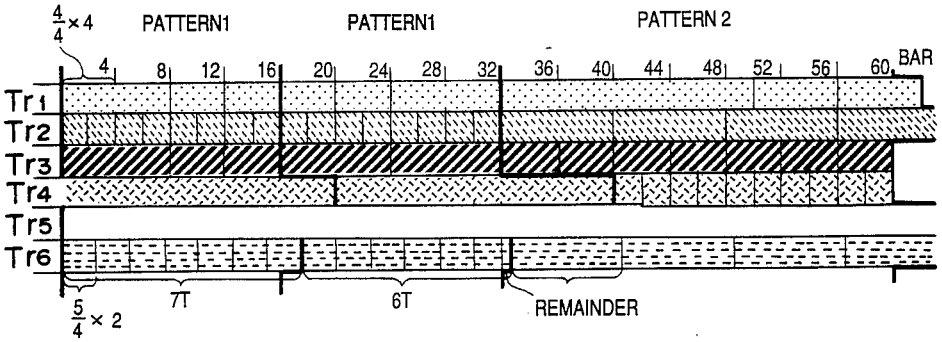
FIG. 3 shows an example of Song data.

FIG. 3 shows an example of Song data. The Song data include Pattern1 repeated twice and Pattern2 not repeated. Each Pattern data consists of a number of Track data. Track data of each track include a unit (hereafter called loop-track bar) repeated several times. For example, in track1, a loop-track bar, having four bars in 4/4 time, is repeated four times; whereas in track6, a loop-track bar having two bars in 5/4 time, is repeated seven or six times in Pattern1 as shown in FIG. 3.

The sequence memory 18 of the embodiment can accommodate 32-Track data, each of which has a different tone color.

Figure 4:
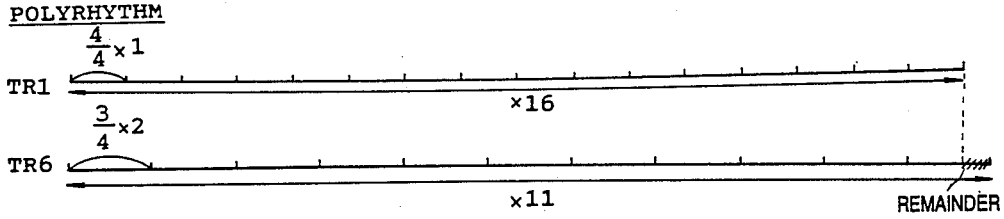
FIG. 4 shows an example of a construction of tracks.

FIG. 4 shows an example of a construction of tracks. Track1, having a tone color of a piano, consists of sixteen bars in 4/4 time; track2, having a tone color of a trumpet, includes eight bars in 4/4 time which is repeated twice in the pattern; track3, having a tone color of a trombone includes 4 bars in 4/4 time which is repeated four times in the pattern; track6, having a tone color of a contrabass, includes two bars in $\frac{3}{4}$ time repeated eleven times in the pattern, and so on. In the case of track6 above, the loop-track bar does not terminate when the pattern ends, and causes remainder in FIG. 4.

These 32-Track data are read out sequentially in a parallel fashion and supplied in parallel to 32 musical-tone-generating channels provided in the tone generator 23. The length of 32-Track data in a Pattern are not necessarily equal as shown in FIG. 3. For example, Track data of track1 consists of four bars repeated four times, while that of track2 consists of two bars repeated eight times. These Track data are repeatedly read out and automatically performed.

The sequence memory 18 can also store Level data in addition to the Pattern data and Song data described above.

As shown in FIG. 4, the Level data consists of 32 Track-Level data, 4 Group-Level data, and Total-Level data. Track-Level data i (i=1 to 32) corresponds to Track data i in the Pattern data described above, and are used to control the volume level of musical sounds produced in musical-tone-generating channel i. Group-Level data k (k=1 to 4) uniformly modifies tone volume of tracks belonging to group k, and Total-Level data is used to uniformly modify tone volume of all tracks. In an automatic performance mode, these Level data are read out from the Level-data area in the sequence memory 18 in accompaniment with the Pattern data, hence controlling the volume level of sound produced from each channel The Level data modifies one of two kinds of data: Volume data and Velocity data. While the Volume data controls only the volume level of sound and causes no change in the waveforms of musical tones, the Velocity data controls not only the volume level but also causes small changes in the waveforms of musical tones. The sequencer selectively modifies either Volume data or Velocity data according to the Level data, which will be described later.

Furthermore, the sequence memory 18 can store Next data that designate the playback sequence (that is, the sequence of replay of Song data), the sequence of tone-color alteration, etc. Setting the Next data in advance in the desired sequence makes it possible to change the tone color, etc., at a touch during a performance.

As stated above, there are four kinds of automatic performance data stored in the sequence memory 18: Pattern data, Song data, Level data, and Next data. Details of these data will be described hereafter.

(1) Pattern data

Figure 5A:
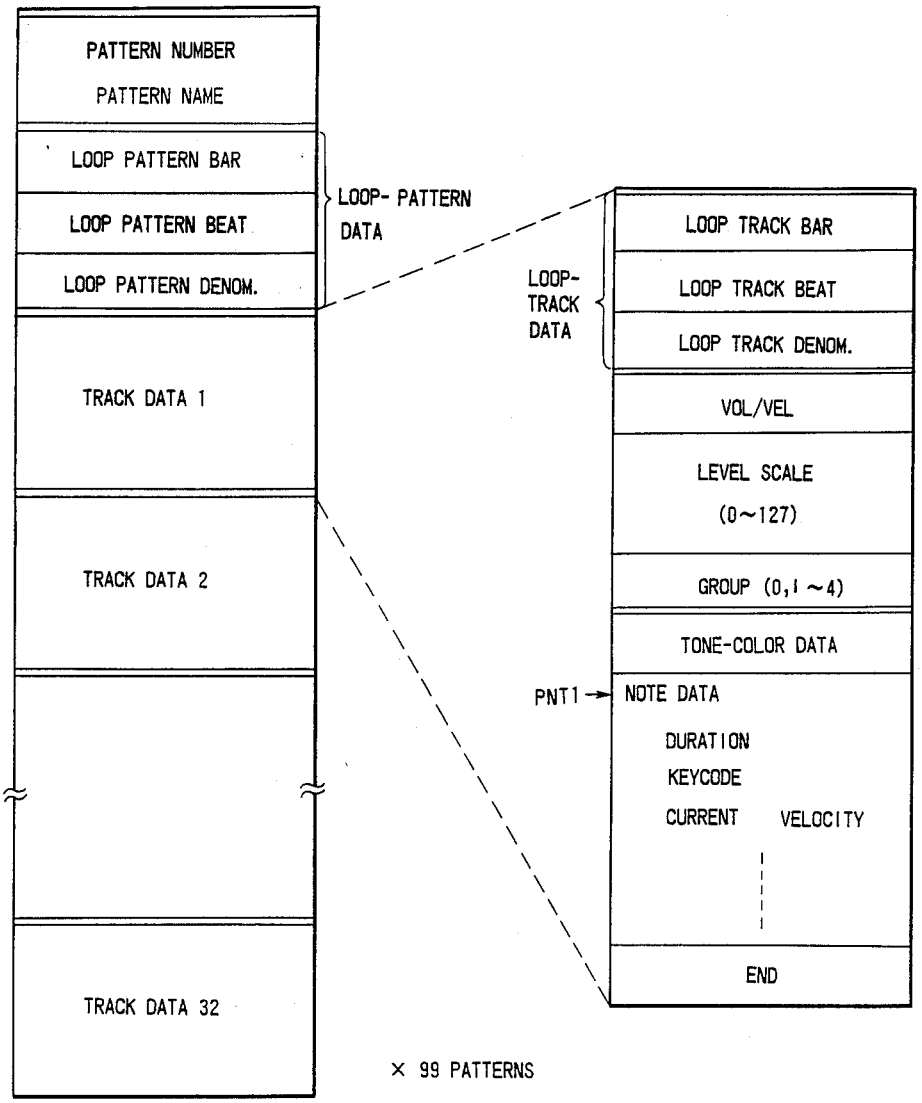
FIG. 5A shows an arrangement of Pattern data.

FIG. 5A shows an arrangement of Pattern data. The Pattern data include the following data.

(A) Pattern Number

Pattern Number designates the number of the Pattern data.

(B) Pattern Name

Pattern Name designates the name of the Pattern data.

(C) Loop-Pattern Bar

Loop-Pattern Bar denotes the duration of the Pattern data by the number of bars.

(D) Loop-Pattern Beat

Loop-Pattern Beat designates beats of time in the Pattern data. For example, "2" in 2/4 time.

(E) Loop-Pattern Denominator

Loop-Pattern Denominator denotes denominator of time in the Pattern data. For example, "4" in 2/4 time.

(F) Track Data 1 to 32

Each set of Track Data includes the following data as shown in FIG. 5A.

(a) Loop-Track Bar

Loop-Track Bar designates the duration of Track Data by the number of bars.

(b) Loop-Track Beat

Loop-Track Beat denotes beats of the Track Data.

(c) Loop-Track Denominator

Loop-Track Denominator designates denominator of the Track Data.

(d) Vol/Vel

Vol/Vel designates which of the two, either Volume data or Velocity data, is to be modified by the Level data.

(e) Level Scale (0 to 127)

The Level Scale contains fundamental data from which the Volume data are generated. When Vol/Vel designates the Volume data, the Level-Scale is modified by the Level data and is supplied to the tone generator 23 as the Volume data. On the other hand, when Vol/Vel designates the Velocity data, the Level Scale is directly supplied to the tone generator 23 as the Volume data.

(f) Group 0: 1, 2, 3, 4

Group denotes a level-control group (described later) to which the track belongs. Group 0 means the track does not belong to any group.

(g) Tone Color

Tone Color designates a tone color of musical tone of a track.

(h) Note data

Note data designate tone pitch, tone volume, and generating timing of musical tones. Note data consist of the following data.

Duration: data designating generation timing of musical tones.

Keycode: data designating pitch of musical tones.

Current Velocity: data from which Velocity data are produced.

On the basis of these Note data, musical tones are produced.

(i) END

END data designates the end of the track.

(2) Song data

Figure 5B:
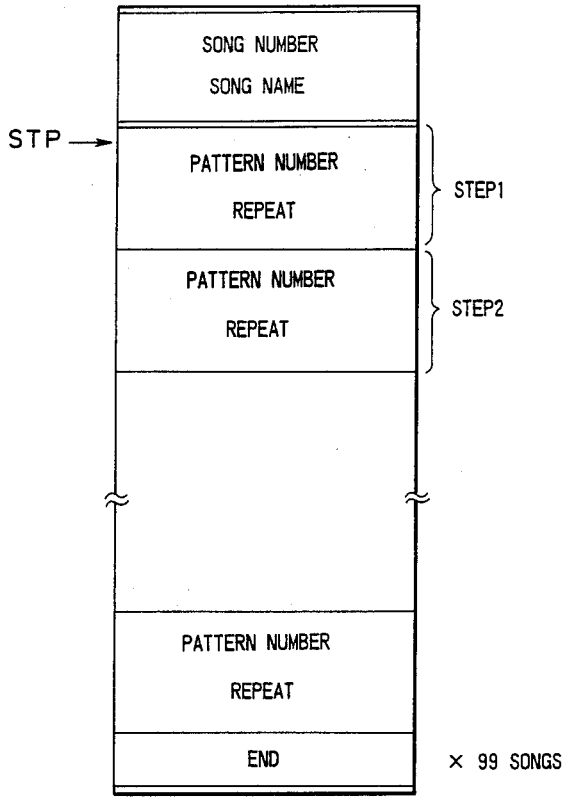
FIG. 5B shows an arrangement of Song data.

FIG. 5B shows an arrangement of Song data. The Song data consist of the following data.

(A) Song Number

Song Number designates the number of the song.

(B) Song Name

Song Name denotes the name of the song.

(C) Pattern Number

Pattern Number designate the numbers of Pattern data to be repeated.

(D) Repeat

Repeat indicates the number of times the Pattern data is repeated. Song data usually includes a plurality of combinations of the Pattern Number and Repeat. Each of the combinations is called a "step".

(E) END

END denotes the end of the Song data.

(3) Level data

Figure 5C:
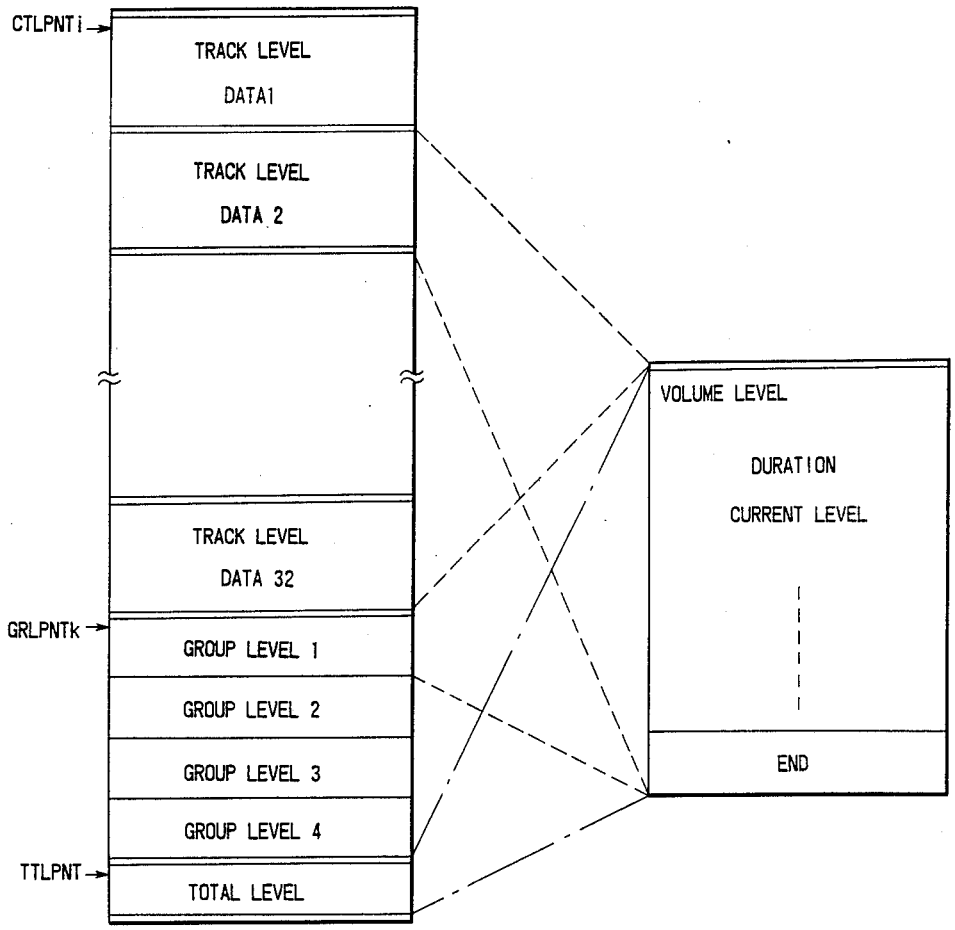
FIG. 5C shows an arrangement of the Level data.

FIG. 5C shows an arrangement of the Level data, which consist of the following data.

(A) Track-Level data 1 to 32

Track-Level data control the volume level of a musical tone produced in each channel of the musical tone generating channel.

(B) Group-Level data 1, 2, 3, 4

The 32-tracks may be divided in up to 4 groups. Within each group, volume control is achieved uniformly and is independent of volume control in the other groups. A track can belong to any group. Group data in Track Data 1 to 32 mentioned above, designate the group to which each track belongs. If the track does not belong to any group, Group data is set to "0". The Group-Level data 1 to 4, on the other hand, are for controlling the volume level of each group.

(C) Total-Level data

Total-Level data uniformly controls the volume of musical tones produced in all the musical tone generating channels.

These three level data, i.e., Track-Level data, Group-Level data, and Total-Level data, consist of Volume-Level data that control the tone volume of musical tones produced in each channel of the musical tone generating circuit. Volume-Level data consist of Duration data that designates timing of volume change, and Current-Level data that indicate the current volume level.

As described above, the sequencer has the following data for controlling the volume of musical tones: Vol/Vel, Level Scale, Current Velocity, Track-Level data, Group-Level data, and Total-Level data.

The Volume data and Velocity data that are selectively supplied to the musical tone generating channel are produced by the following computation.

(1) In the case where the Vol/Vel data indicate the Volume:

$$Volume = Level\ Scale \times WGT \quad (1)$$

where WGT = Track Level × Group-Level × Total-Level $$Velocity = Current\ Velocity \quad (2)$$

(2) In the case where the Vol/Vel data indicate the Velocity:

$$Volume = Level\ Scale \quad (3)$$

$$Velocity = Current\ Velocity \times WGT \quad (4)$$

(4) Next data

FIG. 6 shows an arrangement of Next data, which consists of the following data.

(A) Nx1

There are three kinds of Nx1 data:

| upper 2 bits | lower 6 bits |
|---|---|
| 01 | track number |
| 10 | Don't care |
| 11 | Don't care |

(B) Nx2

Nx2 is defined as follows in connection with Nx1:

| Nx1 | Nx2 |
|---|---|
| 01 | tone-color number |
| 10 | combination-table number |
| 11 | Song data number |

Figure 6A:
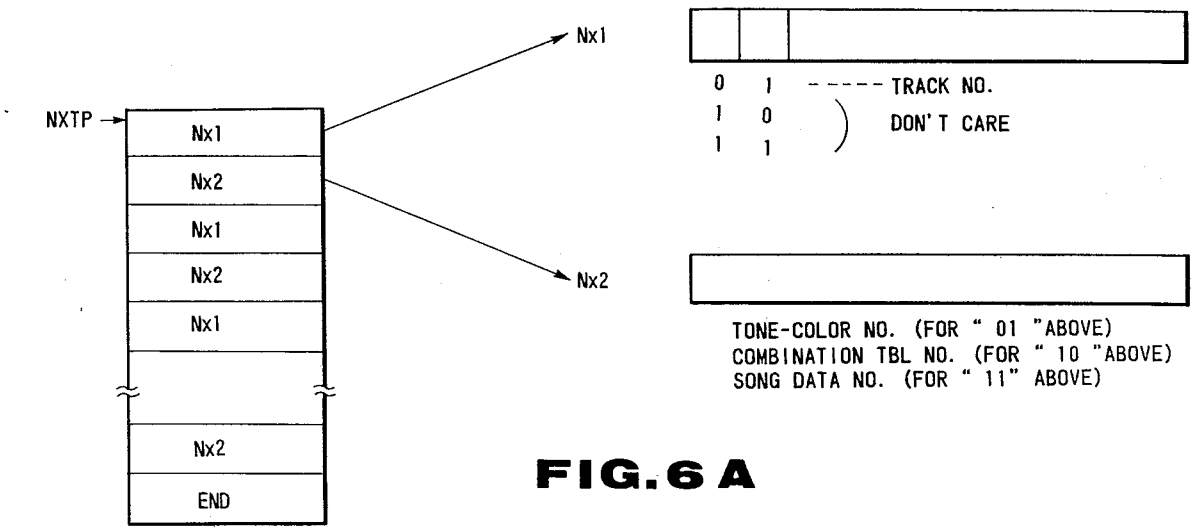
FIG. 6A shows an arrangement of Next data.
Figure 6B:
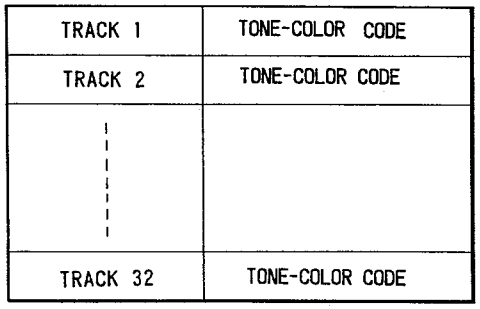
FIG. 6B shows a construction of a combination table.

The combination table above is shown in FIG. 6B. It contains tone-color data for each of 32-tracks. The sequence memory 18 includes a plurality of such combination tables so that one of the combination tables can be used selectively. The combination-table number is the number of the table.

[OPERATION]

The operation of the sequencer will be described referring to FIG. 7A through FIG. 20.

Figure 7A:
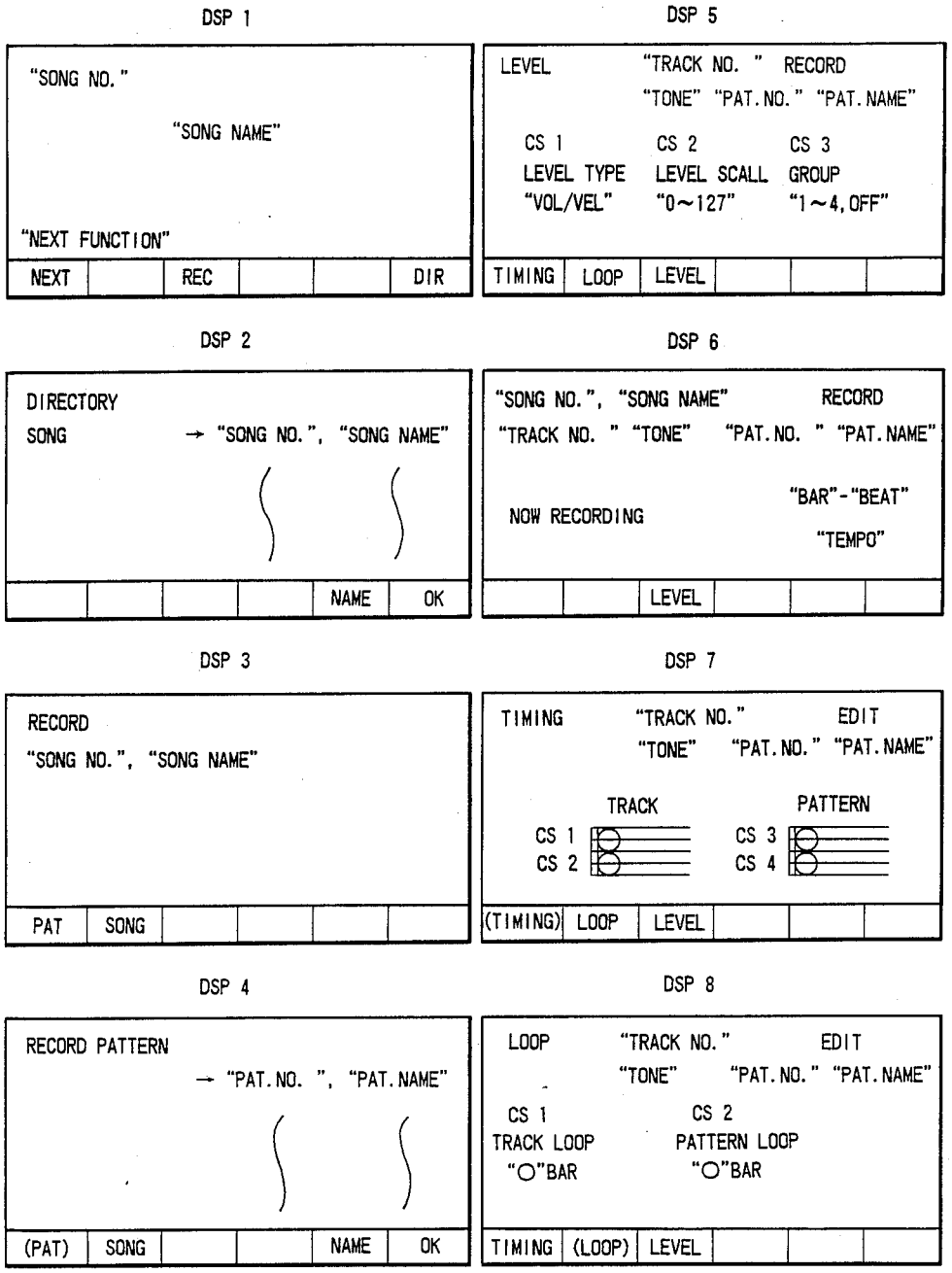

FIG. 7A and 7B are pictorial views showing displays on the screen of LCD 2, FIGS. 8A and 8B are diagrams showing display numbers, and the relationships between switch operation and the results thereof. FIGS. 9 through 20 are flowcharts showing the processes of the CPU 15.

At the bottom of each screen shown in FIG. 7A and 7B, the names of multifunction switches M1 to M6 from FIG. 1 are displayed. For example, "Next" at the bottom of DSP1 screen, means that the multifunction switch M1 functions as a Next switch. In FIGS. 8A and 8B, DSPi (i=1 to 15) denotes the screen names and "(switch name)" denotes switch operation.

In the flowcharts of FIG. 9 to FIG. 20, the following abbreviations are used to designate registers:

| | |
|---|---|
| VOLUME.R1 to 32 | Volume register |
| VELOCITY.R1 to 32 | Velocity register |
| PNT1 to 32 | pointer register (see FIG. 5A) |
| STP | step-pointer register (see FIG. 5B) |
| CTLPNT1 to 32 | Track-Level-pointer register (see FIG. 5C) |
| GRPPNT1 to 4 | Group-Level-pointer register (see FIG. 5C) |
| TTLPNT | Total-Level-pointer register (see FIG. 5C) |
| NXTP | next pointer register (see FIG. 6A) |
| PCLK | Pattern-clock register |

-continued

| | |
|---|---|
| TCLK1 to 32 | track-clock register |
| CPCLK | current Pattern-clock register |
| CTCLK1 to 32 | current track-clock register |
| EVTDUR1 to 32 | event-duration-measurement register |
| CTLDUR1 to 32 | Track-Level-duration-measurement register |
| GRPDUR1 to 4 | Group-Level-duration-measurement register |
| TTLDUR | Total-Level-duration-measurement register |
| TRKN0 | track-number register |
| CTL1 to 32 | Track-Level register |
| GRL | Group-Level register |
| TTL | Total-Level register |
| PEND1 to 32 | pending flag register |
| WGT | weight register |
| CHG1 to 32 | change register |

Each process of the embodiment will hereafter be described referring to the flowcharts.

(1) PATTERN RECORD

First, the Pattern Recording operation will be described. It is a process for writing the Pattern data to the Pattern data area shown in FIG. 5A. Before writing the pattern, initial setting is performed.

(A) Initial Setting

SEQ: a performer turns on switch SEQ provided at the keyboard portion.

DSP1: when the switch SEQ is turned on, DSP1 shown in FIG. 7 appears on the screen of LCD 2. In this case, "Song No." (Song data number) is "01" (Song No. 1), and "Song Name" (Song data name) is not displayed.

REC: the performer turns on REC switch (multifunction switch M3) to select a Record mode.

DSP3: when REC switch is depressed, DSP3 appears on the screen. In this case, "Song No." and "Song Name" are maintained in the previous state.

PAT: the performer turns on the PAT switch (M1 sw) to select a Pattern mode.

DSP4 when the PAT switch is pressed, DSP4 appears on the screen, and the "Pattern Number" is displayed as follows.

```
  01
- 02 (- mark designates cursor)
  03
  04
  . . .
```

"Pattern Name" is not displayed because no Pattern has been written yet.

CURSOR: to set Pattern No.1, for example, the performer moves the cursor to "01" on the screen by operating cursor switches 9 and 10.

NAME: the performer presses the Name switch (multifunction switch M5) to enter a Pattern name using the track-designation switch 12. The Pattern name entered is displayed on the right-hand side of the Pattern number "01" in DSP4, and is written into the Pattern data area in the sequence memory 18, together with the Pattern number "01" (see FIG. 5A).

OK: the performer turns on OK switch.

DSP5: when OK switch is depressed, DSP5 appears. Here, the performer enters the track number by use of the track-designation switch 12, then sets the tone color by using the tone-color switch. The entered track number and the tone color are respectively displayed at positions of "Track Number" and "Tone" on DSP5.

CS1: the performer enters Vol/Vel data, Level Scale data, and Group data by use of continuous sliders CS1 to CS3. Vol/Vel data is entered by setting the position of continuous slider CS1: setting the position of the slider lower than the center position causes Vol/Vel data to be set at "1", designating Volume data; while setting it above the center position causes Vol/Vel data be set at "0", designating Velocity data.

CS2: Level Scale data is entered by setting the position of the continuous slider CS2: when the slider is moved up from the bottom to the top thereof, the displayed number of the Level Scale sequentially increases from "0" to "127" in accordance with the position of the slider, and the number is set to the sequence memory 18 as Level Scale data.

CS3: Group data is entered by setting the position of the continuous slider CS3: when the slider is placed at the bottom, "0" is displayed, then as the slider is moved up, the value increases gradually taking a value "1", "2", or "3", ending with the value "4" at the top. The value displayed is set into the sequence memory 18 as Group data.

Timing: when the performer turns on the Timing switch, the screen changes from DSP5 to DSP7. Here, the performer enters Loop-Track-Beat data, Loop-Track-Denominator data, Loop-Pattern-Beat data, and Loop-Pattern-Denominator data using continuous sliders CS1 to CS4.

CS1: when the performer moves the slider of continuous slider CS1, one of the values "1" to "99" is displayed depending on the position of the slider. Thus the performer can enter a desired value as Loop-Track-Beat data while viewing the display.

CS2: when the lever of continuous slider CS2 is moved, one of the values "2", "4", "8", "16", "32" is sequentially displayed. A selected value among these values is set as Loop-Track-Denominator data to the sequence memory 18.

CS3: when the performer moves the lever of continuous slider CS3, one of the values "1" to "99" is displayed depending on the position of the slider. Thus the performer can enter a desired value as Loop-Pattern-Beat data while viewing the display.

CS4: when the lever of continuous slider CS4 is moved, one of the values "2", 37 4", "8", "16", "32" is sequentially displayed. A desired value among these values is set as Loop-Pattern-Denominator data to the sequence memory 18.

LOOP: when the performer turns on Loop switch, DSP8 appears, and the performer can enter Loop-Track-Bar data and Loop-Pattern-Bar data using the continuous sliders CS1 and CS3.

CS1: with the movement of the slider of CS1, one of the values "1" to "127" is sequentially displayed, and a desired value among them is set into the sequence memory 18 as Loop-Track-Bar data.

CS3: with the movement of the slider of CS3, one of the values "1" to "127" is sequentially displayed, and a desired value among them is set into the sequence memory 18 as Loop-Pattern-Bar data.

Thus, the initial setting for the Pattern Recording process is completed.

EXIT: on completion of the initial setting, the performer activates the EXIT switch (see FIG. 1).

DSP5: when the EXIT switch is depressed, DSP5 is displayed.

Subsequently, the performer turns on the START switch and carries out a performance on the keyboard 1 to write performance data into the track i (i=one of 1 to 32) which has been selected by the process described above.

Figure 9:
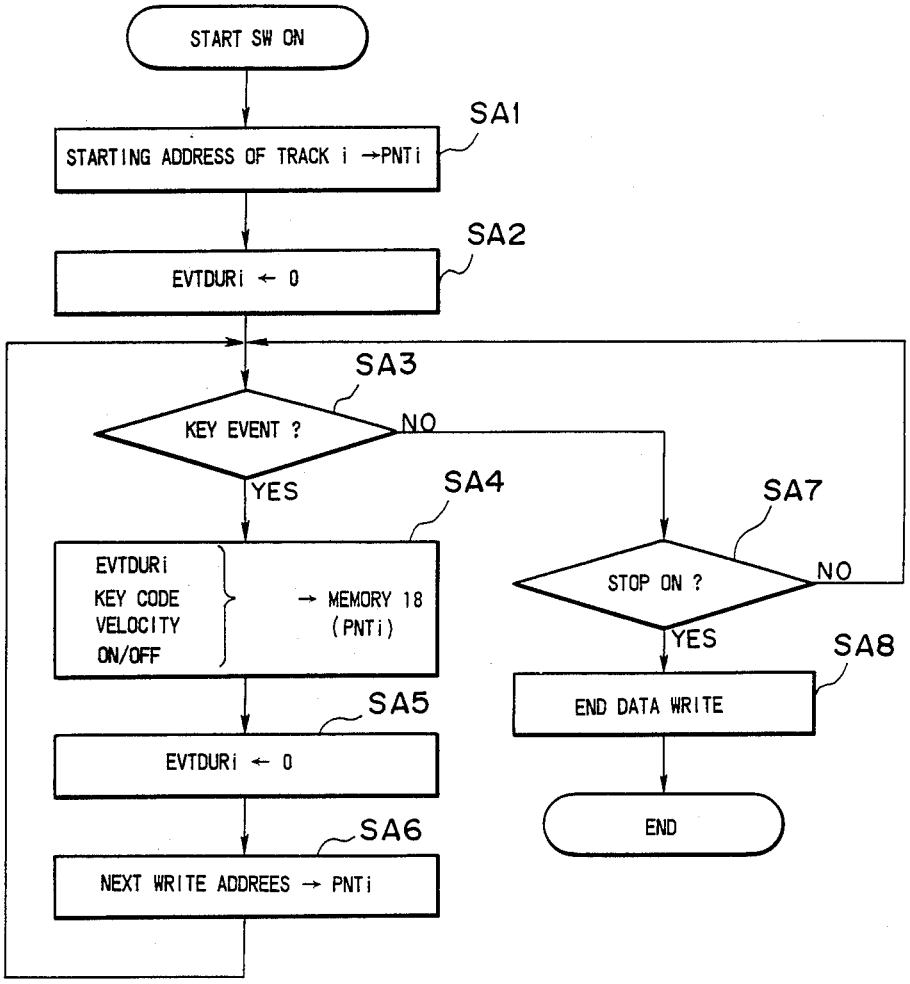
FIG. 9 is a flowchart showing the process of Pattern Recording.
Figure 10:
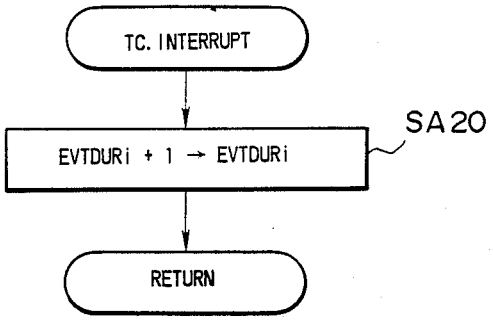
FIG. 10 is a flowchart showing the process of interrupt caused by tempo clock TC.
Figure 14:
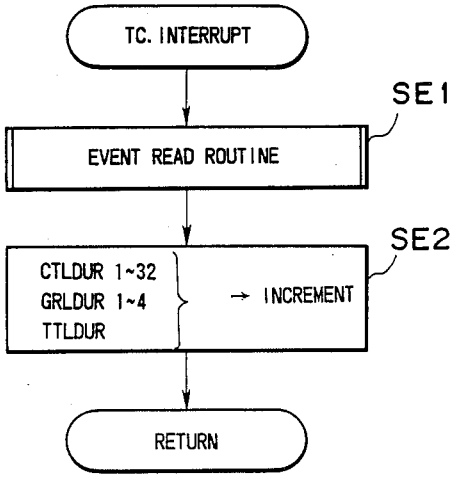
FIG. 14 is a flowchart showing the process of interrupt caused by tempo clock TC in the case where Song Play and Level Recording is being performed.

When the START switch is turned on, the display DSP5 turns into DSP6, and the process shown in FIG. 9 is carried out by the CPU 15.

(B) Pattern Write

FIG. 9 shows the process of Pattern recording. Every key event is recorded into the sequence memory 18 in the form of keycode, key-velocity, key on-off and duration of key depression.

At step SA1, the CPU 15 sets the starting address of Note-data area of track i into pointer register PNTi. Track i is a track selected above. At step SA2, event-duration-measurement register EVTDURi is cleared to zero to store the duration of key depression. At step SA3, the occurrence of a key event is tested. A key event is a change in the state of a key on the keyboard 1. More specifically, it means the on-off operation of one of the keys on the keyboard 1. If no event has occurred, the CPU 15 proceeds to step SA 7 in which a test is performed to determine whether the STOP switch is turned on or not. If the result is negative, controls returns to step SA 3, and steps SA3 and SA7 are repeatedly performed.

From the starting point of the process, i.e., after the START switch is turned on, every pulse of tempo clock TC from the tempo clock generator 19 (see FIG. 1) causes interrupt to the CPU 15. The tempo clock TC consists of clock pulses that occur 96 times during a quarter note, and functions as the time basis of automatic performance. When the interrupt occurs, the CPU 15 proceeds to the interrupt routine shown in FIG. 10. At step SA20 in FIG. 10, the content of register EVTDURi is incremented and returns to the flowchart in FIG. 9. Thus, the content of register EVTDURi indicates the elapsed time based on the tempo clock TC, after it is cleared at step SA2

When a certain key is depressed (or released), the test at step SA3 becomes positive, and the CPU 15 proceeds to step SA4. At step SA4, the content of register EVTDURi, keycode of the depressed key, key-velocity thereof, and key-on/off data are written into locations in the memory 18 whose starting address is indicated by the pointer register PNTi. At the next step SA5, the content of register EVTDURi (i=1 to 32) is cleared to zero, and then at step SA6, the next write address of the Note-data area is set into the pointer register PNTi to indicate the address of locations in the memory 18 to which next data is written. After that, the CPU 15 returns to step SA3, repeating the steps SA3 to SA7. In the course of this, the content of register EVTDURi is cleared to zero every time a key event occurs, and is incremented by tempo clock TC after each clearing Thus, the duration of each key event is being measured.

When another key is depressed, the CPU 15 proceeds to step SA4 in a similar manner described above. At step SA4, the content of register EVTDURi, the keycode of the depressed key, the key velocity thereof, and the key-on/off data, are all written into locations in the memory 18. At the next step SA5, the content of register EVTDURi is cleared to zero, and then at step SA6, the next write address of key data is set into the pointer register PNTi. After that, the CPU 15 returns to step SA3, repeating the steps SA3 to SA7. Thus, every time an event occurs the content of register EVTDURi (i.e., duration of a note), keycode of a depressed or released key, key velocity data thereof, and key-on/off data are sequentially written into the Note-data area in the sequential memory 18.

When the performance has finished, the performer turns on the STOP switch. As a result, the test result at step SA7 becomes positive and the program proceeds to step SA8 where the END data is written into the terminus of the Note-data area. Thus, the writing of the performance data into track i is completed. When the STOP switch is pressed again, the display returns to DSP5.

(2) SONG RECORD

This is a process to write Song data that designate a sequence of Pattern data into the Song data area shown in FIG. 5B. The process is carried out as follows.

(A) Initial Setting

SEQ on: a performer turns on the SEQ switch provided at keyboard portion.

DSP1: DSP1 screen shown in FIG. 7A appears.

DIR on: the performer presses a directory switch (multifunction switch M6) to select Song No.

DSP2: when the directory switch is turned on, DSP1 changes to DSP2 where Song Numbers and Song Names appear.

CURSOR: the performer operates cursor switches 9 or 10 to move the cursor for the selection of a desired Song No.

NAME: the performer depresses NAME switch (multifunction switch M5) and enters Song Name using switches 12.

OK: after entering Song Name, the performer depresses OK switch (multifunction switch M6). Song No. and Song Name are written into the Song data area.

DSP1: when the OK switch is pressed, DSP1 appears again to display Song No. and Song Name set above.

REC: the performer presses REC switch to enter into record mode.

DSP3: when the REC switch is depressed, the screen changes to DSP3 where Song No. and Song Name is shown.

SONG: the performer depresses Song switch (M2 switch) to enter into the Song Recording mode.

DSP11: when the Song switch is pressed, DSP11 appears.

CHAIN: the performer depresses CHAIN switch (M4 switch).

DSP12: when the CHAIN switch is turned on, DSP11 appears where Step No., Pattern No., Pattern Name and Repeat data can be entered.

Thus, the initial setting of the Song data recording is completed.

(B) Song data write

Figure 11:
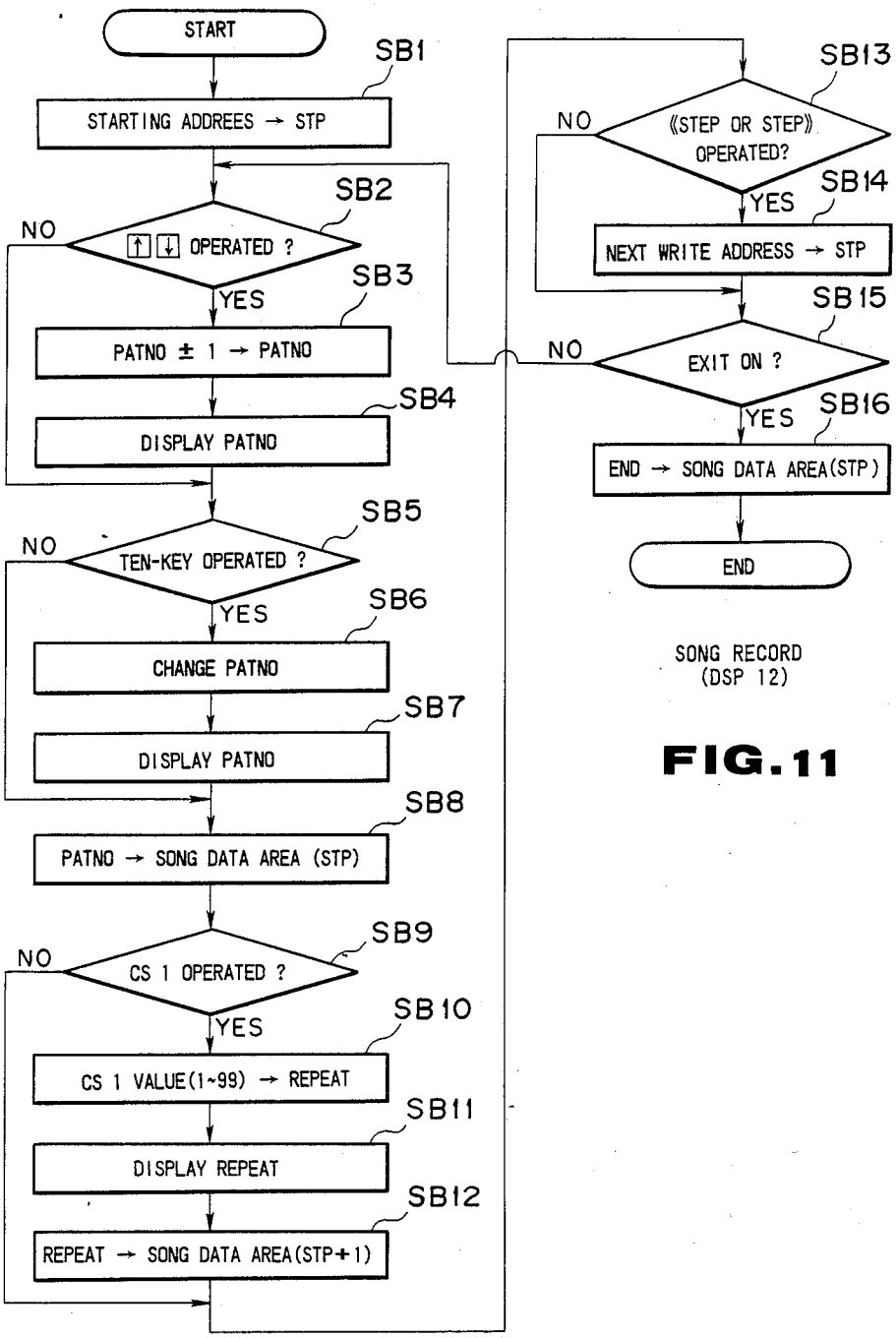
FIG. 11 is a flowchart showing the process of Song Recording.

FIG. 11 is a flowchart showing the process of Song Record. In the process, a number of steps that constitute Song data, each consisting of Pattern Number data and Repeat data as shown in FIG. 5B, are set in a serial fashion into the Song data area in the sequence memory 18.

When the START switch is turned on while displaying DSP12, the starting address of the Song data area is loaded to the step-pointer register STP at step SB1 in FIG. 11. Here, the performer selects a Pattern No. using cursor switches 9 and 10, or the ten-keypad 11. First, at step SB2, a test is performed to determine whether the performer has operated the cursor switches 9 and 10. If either of them is operated, the Pattern No. is incremented or decremented by 1 according to the operated cursor switch. The resulting value is written into the PATNO register (not shown) at step SB3, and the content thereof is displayed on the screen DSP12 together with the Pattern Name and Step No. (step SB4).

On the other hand, when the ten-keypad 11 is operated, the CPU 15 determines this at step SB5 and proceeds to step SB6. At step SB6, the Pattern No is changed in accordance with the designation of the ten-keypad 11, and is stored into the PATNO register The Pattern No. in PATNO register is displayed on the screen DSP12 at step SB7 The Pattern No , thus determined using the cursor switch 9 or 10, or the ten-keypad 11, is written into the address in the Song data area indicated by the step-pointer register STP at step SB8.

Next, the Repeat data that designates repetition times of the Pattern data is written. At step SB9, the CPU 15 tests whether the continuous slider CS1 is operated if it is operated, a value of CS1 is transferred to a REPEAT register (not shown) at step SB10. In addition, the content of the REPEAT register is displayed on the screen DSP12 at step SB11, and also transferred to the address next to that indicated by the step-pointer register STP at step SB12 Thus, one step of the Song data is written into the Song data area in memory 18.

After that, when the <<Step switch or Step>> switch is operated, the CPU 15 determines this at step SB13 and sets the next write address into the step-pointer register STP at step SB14. Steps SB2 to SB14 are repeatedly performed until the performer depresses the EXIT switch. As a result, Pattern No. and Repeat data are successively entered until the operation of the EXIT switch. Depression of the EXIT switch is determined at step SB15, and the END data is set to the address indicated by the step-pointer register STP at step SB16. Thus, the Song Recording process is completed.

(3) SONG PLAY AND LEVEL RECORD 1

In this process, Pattern data are read out sequentially according to Song data, and are played back At the same time, Group-Level data and Total-Level data are written into the data area thereof shown in FIG. 5C. The process is carried out as follows.

(A) Initial Setting

SEQ on: a performer turns on the SEQ switch provided at keyboard portion.

DSP1: DSP1 screen shown in FIG. 7A appears.

DIR on: the performer presses a directory switch to select the Song No.

DSP2: when the directory switch is turned on, DSP1 changes to DSP2 where Song Numbers and Song Names appear.

CURSOR: the performer operates cursor switches 9 or 10 to move the cursor for the selection of a desired Song No.

OK: after the selection of the Song No., the performer depresses OK switch (M6 switch). The Song No. selected is stored in CPU 15.

DSP1: when the OK switch is pressed, DSP1 appears again to display the Song No. and the Song Name selected above.

REC: the performer presses REC switch (M3 switch) to enter into the recording mode for Level data.

DSP3: when the REC switch is depressed, the screen changes to DSP3 where the Song No. and the Song Name are shown.

SONG: the performer presses Song switch (M2 switch) to enter into the Song mode.

DSP11: when the Song switch is pressed, DSP11 appears.

LEVEL: the performer depresses Level switch (M5 switch).

DSP13: when the Level switch is pressed, DSP13 appears where Group Level and Total Level can be set.

Thus, the initial setting of the Song play and Level record mode 1 is completed.

(B) Song Play and Level data write 1

Figure 12:
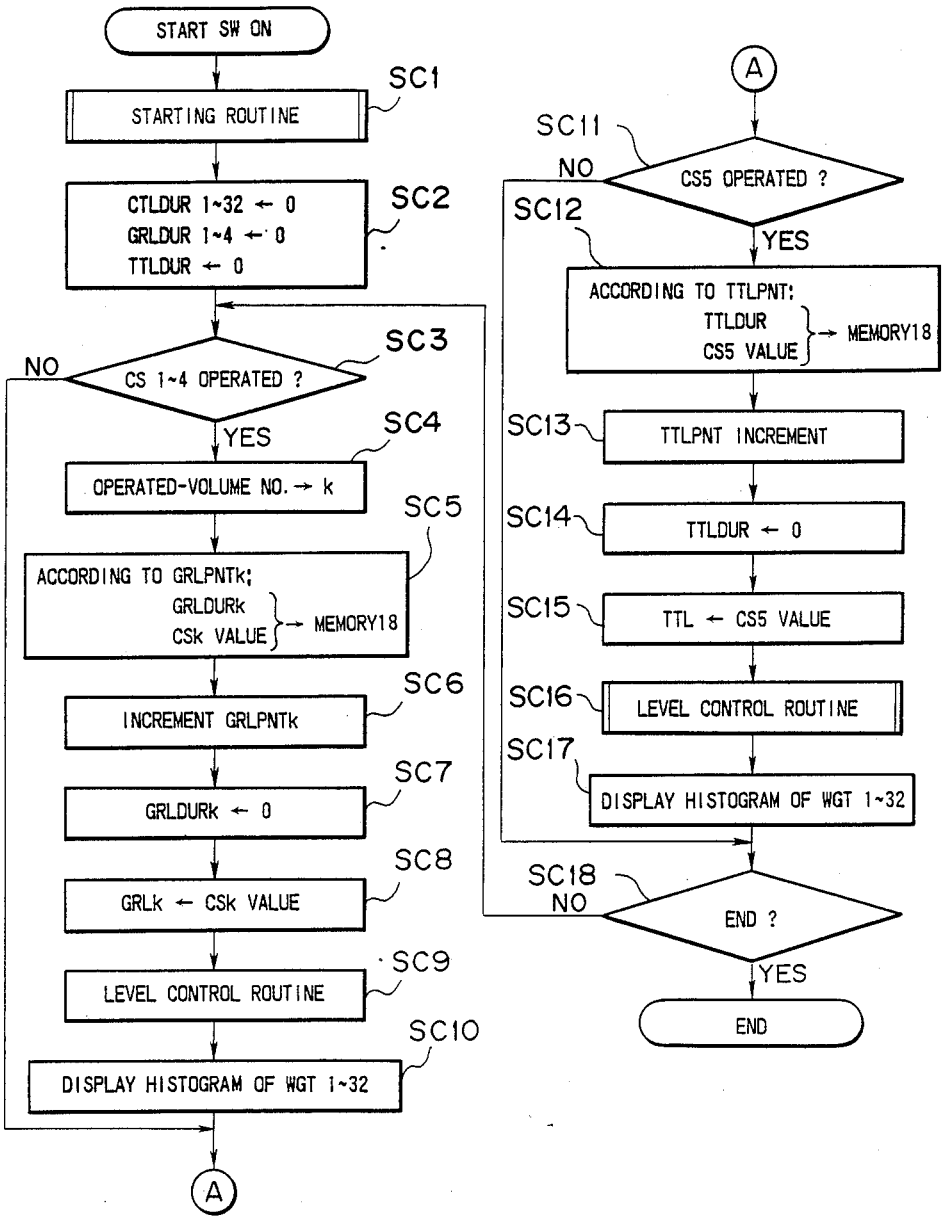
FIG. 12 is a flowchart showing the process of Song Play and Level Record 1.

FIG. 12 is a flowchart showing the process of Song Play and Level data write. In this process, Group-Level data and Total-Level data shown in FIG. 5C, are set into the Level-data area in the sequence memory 18. These Level data consist of Duration and Current Level data as shown in FIG. 5C. The Track-Level data are set in Song Play and Level Data Write 2 mode, which will be described later.

When the START switch is turned on while displaying DSP13, the START ROUTINE is performed at step SC1 in FIG. 12.

Figure 13:
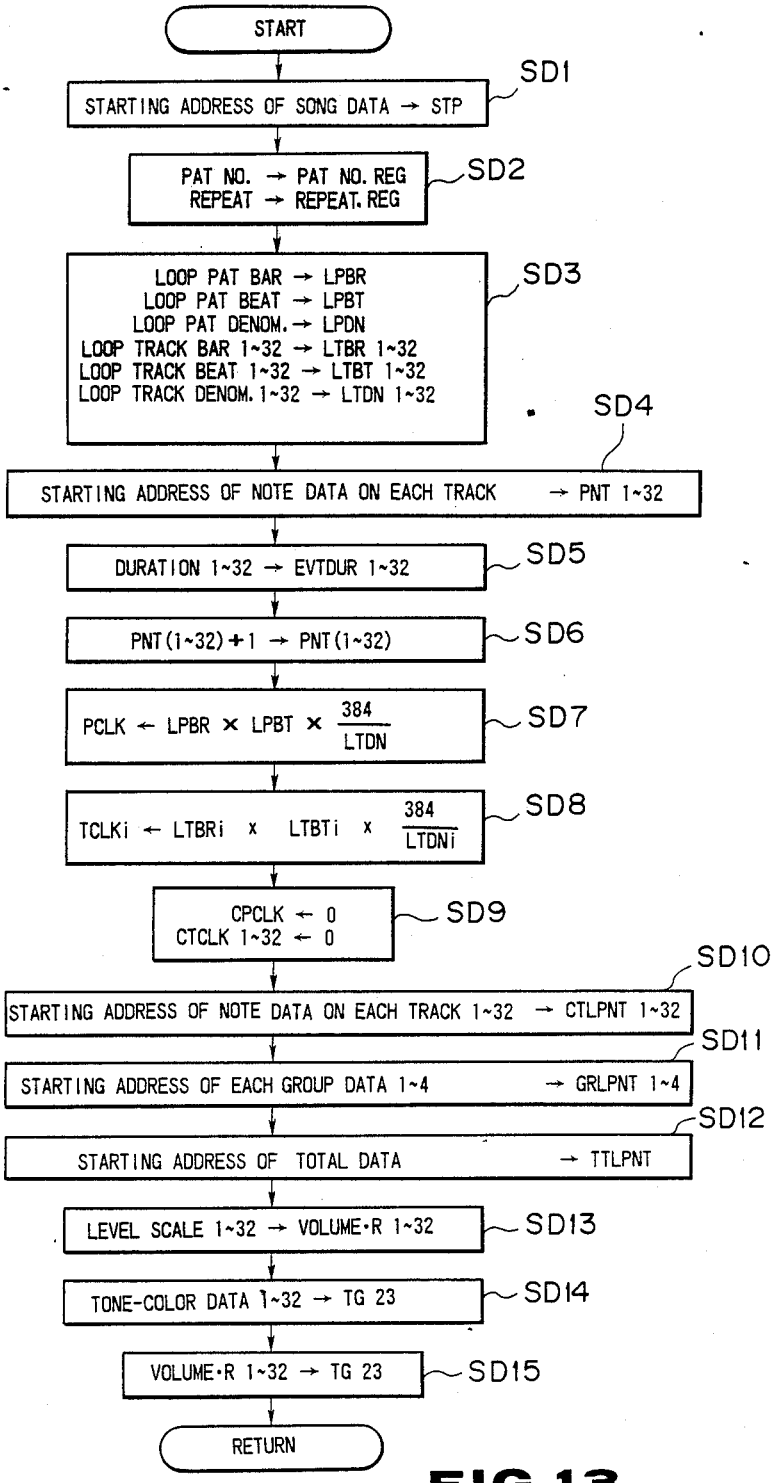
FIG. 13 is a flowchart of START ROUTINE.

FIG. 13 is a flowchart of the START ROUTINE. In this process, initial data for Song play and Level write is set to the appropriate registers. First, the starting address of Song data is set to step-pointer register STP at step SD1. At step SD2, Pattern Number and Repeat data are respectively set to PATNO and REPEAT registers. At step SD3, additional data regarding to Song Play are written to registers (not shown). Specifically, Loop-Pattern-Bar is set to a register LPBR; Loop-Pattern-Beat, to a register LPBT; Loop-Pattern-Denominator, to a register LPDN; Loop-track-Bar 1 to 32, to registers LTBR1 to 32; Loop-track-Beat 1 to 32, to registers LTBT1 to 32; and Loop-track-Denominator 1 to 32, to registers LTDN1 to 32. At step SD4, the starting address of Note data on each track is set to each pointer register PNTI to 32. At step SD5, Duration of the Note data 1 to 32 are respectively loaded to registers EVTDUR1 to 32. At step SD6, each pointer register PNT1 to 32 is incremented by 1 to indicate the next address of the Note data.

Next, timing data are computed and written into the appropriate registers. At step SD7, pattern length is computed using the following equation, and the resulting pattern length is set to a Pattern-clock register PCLK.

$$\textit{pattern length} = LPBR \times LPBP \times (384/LTDN)$$

where

LPBR denotes the number of bars included in the Pattern

LPBP denotes the number of beats included in the bar

LTDN denotes the denominator of time one beat length is 384/LTDN because 96 pulses of the tempo clock occurs in a quarter note ($384 = 96 \times 4$). At step SD8, track length is computed in a similar manner using the following equation, and the resulting track length is stored in the track-clock register TCLK.

$$\textit{track length of track } i = LPBRi \times LPBPi \times (384/LTDNi)$$

where

LPBRi denotes the number of bars included in the track i

LPBPi denotes the number of beats included in the bar

LTDNi denotes the denominator of time of the track i

Thus, the Loop-Pattern length and the Loop-Track length are computed and stored in the appropriate registers. At step SD9, the current Pattern-clock register CPCLK that indicates the elapsed time of the current Pattern, and the current track-clock registers CTCLK1 to 32 that indicate the elapsed time of each track, are all cleared to zero.

From step SD 10 to SD 12, the starting address of each Level data is loaded into the pointer registers thereof. Specifically, the starting address of each Track-Level data 1 to 32 is loaded to each current-Track-Level-pointer register CTLPNT1 to 32 respectively (step SD10), the starting address of each Group-Level data 1 to 4 is stored in each Group-Level-pointer register GRLPNT1 to 4 (step SD11), and the starting address of Total-Level data is loaded to Total-Level-pointer register TTLPNT (step SD12).

Finally, after each Level Scale 1 to 32 is loaded to each volume register VOLUME.R1 to 32 at step SD13, Tone-Color data 1 to 32, and the contents of volume registers VOLUME.R1 to 32 are supplied to the tone generator 23 where music tones are produced (step SD14, SD15), followed by a return to the mainline in FIG. 12.

At the step SC2 in FIG. 12, three kinds of level-duration-measurement registers, i.e., current-Track-Level-duration-measurement registers CTLDUR1 to 32, Group-Level-duration-measurement registers GRLDUR1 to 4, and Total-Level-duration-measurement register TTLDUR, are all cleared to zero.

From the starting point of the process, i.e., after the START switch is turned on, every pulse of tempo clock TC from the tempo clock generator 19 (see FIG. 1) causes an interrupt in the CPU 15. The tempo clock TC consists of clock pulses that occur 96 times during a quarter note, and functions as a time basis of automatic performance. When an interrupt occurs, the CPU 15 proceeds to the interrupt routine shown in FIG. 14. At step SE1 in FIG. 14, the CPU 15 jumps to EVENT READ ROUTINE to perform the process for Song Play. After returning from the routine, at step SE2, the CPU 15 increments three kinds of registers to measure the level durations for Level Record. These registers are current-Track-Level-duration-measurement registers CTLDUR1 to 32, Group-Level-duration-measurement registers GRLDUR1 to 4, and Total-Level-duration-measurement register TTLDUR mentioned above.

Figure 15:
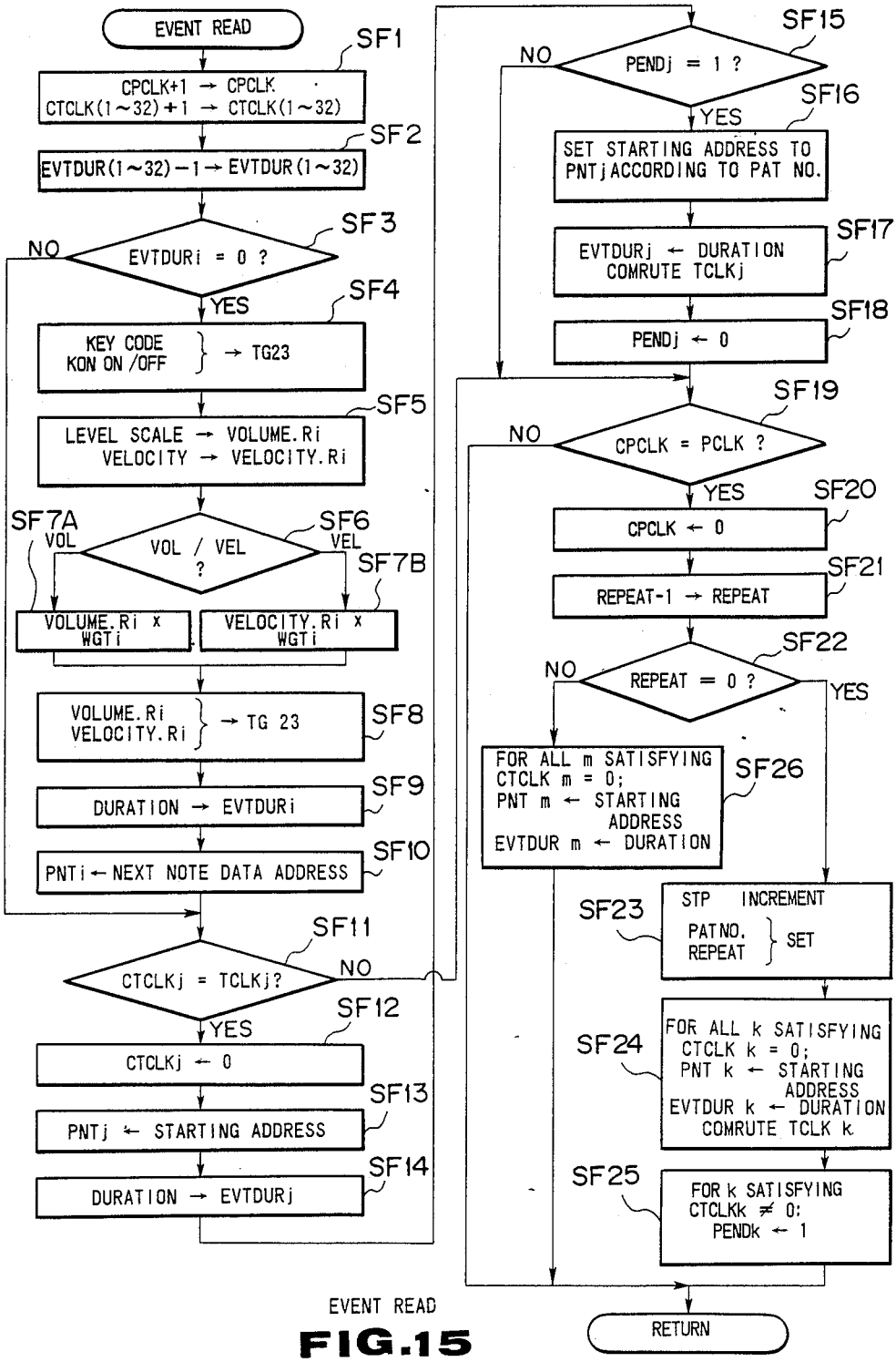
FIG. 15 is a flowchart of EVENT READ ROUTINE.

FIG. 15 is a flowchart of the EVENT READ ROUTINE. The CPU 15 carries out the process every time the interrupt by tempo clock TC occurs and tests the termination of each duration: event duration (note length), track duration, current Pattern duration.

At step SF1, the CPU 15 increments the current Pattern-clock register CPCLK and current Track-clock registers CTCLK1 to 32, as well as decrements the event-duration-measurement registers EVTDUR1 to 32 at step SF2. Hence, the duration of Pattern, the tracks, and the events on each track, are being measured.

From step SF3 to SF10, the termination of an event is detected, followed by a continuation of the program. At step SF3, the CPU 15 tests whether the event-duration-measurement registers EVTDURi (i=1 to 32) of each track is zero. If a register is zero, the CPU 15 outputs new Note data and updates the appropriate registers. Specifically, the CPU 15 supplies keycode data and key-on/off data to the tone generator 23 at step SF4, and sets Level Scale and Velocity data to the VOLUME.Ri and VELOCITY.Ri registers, respectively, at step SF5. The CPU 15, then, proceeds to step SF6 and tests if Vol/Vel data indicates Volume or Velocity. If Volume is indicated, the content of VOLUME.Ri is multiplied by weight WGTi aforementioned at step SF7A, whereas if Velocity is indicated, the content of VELOCITY.Ri is multiplied by weight WGTi at step SF7B. Subsequently, the contents of registers VOLUME.Ri and VELOCITY Ri are supplied to the tone generator 23 at step SF8. Thus, the tone generator 23 produces a tone based on the new Note data. After this, the CPU 15 sets Duration data of track i to event-duration-measurement register EVTDURi (step SF9), and also loads the next event address, i.e., the address of next Note data, to pointer register PNTi (step SF10).

In the case where the test result at step SF3 is negative, or step SF10 is completed, the CPU 15 proceeds to step SF11. From step SF11 to SF14, the termination of track duration is detected followed by a continuation of the program. At step SF11, the CPU 15 tests whether the content of current-track-clock register CTCLKj (j=1 to 32) equals that of track-clock register TCLKj If they are equal, the CPU 15 clears the register CTCLKi to zero (step SF12), loads the starting address of the Note data area to pointer register PNTj (step SF13), and sets new Duration data to the event-duration-measurement register EVTDURj (step SF 14).

When step SF14 is completed, the CPU 15 proceeds to step SF15. The process from step SF15 to SF18 will be described later In the case where the test result at step SF11 is negative, or step SF18 is completed, the CPU proceeds to step SF19 where it tests whether the content current-Pattern-clock register CPCLK equals that of Pattern-clock register PCLK. If the result is positive, that is, the Pattern is completed, the register CPCLK is cleared to zero at step SF20, and REPEAT register is decremented by 1 at step SF21. At step SF22, the CPU 15 tests whether the content of REPEAT register is zero. If it is zero, this means that the step of the Song including the Pattern (see FIG. 5B) is completed and next step thereof should be started. Hence, at step SF23, the CPU 15 increments step-pointer register STP, and sets new Pattern No. and Repeat data to registers PATNO and REPEAT respectively. After that, the CPU 15 tests all the current-track-clock register CTCLKk to check whether they are zero or not. If the register CTCLKk is zero, this means that track k has also finished the step of the Pattern (see step SF11 and SF12), and so the next step of the track k should be started. Hence, at step SF24, for all values of k that satisfy CTCLKk=0, the CPU 15 sets the starting address of Note data area of track k of the new Pattern designated at step SF23 to pointer register PNTk, and Duration of the Note data to EVTDURk register. Furthermore, the CPU 15 computes the track clock of the new Pattern and stores it in the TCLKk resister. Thus, the next step of the Song begins.

On the other hand, there may be some tracks whose current-track-clock registers CTCLKk do not indicate zero. This means that the Pattern has not yet finished at the track k i.e., the track k has a remainder of the Pattern (see FIG. 3 and 4). In such a case, the CPU 15 continues to play the remainder to its end, setting the pending flag PENDk of the track k at step SF25.

When the test result at step SF22 is negative, i.e., when the Pattern should be repeated again, the CPU 15 proceeds to step SF26 where it checks all the current-track-clock registers CTCLKm (m=1 to 32). If the content of CTCLKm is zero, this means that track m has finished the Pattern, and so must repeat it again. Hence, the CPU 15 sets the starting address of Note data of track m of the Pattern in pointer register PNTm, and the duration thereof in event-duration-measurement register EVTDURm.

From step SF15 to SF18 mentioned above, a process concerning the pending flag PENDk (see step SF25) is performed. The pending flag PENDj has been set to "1" in the case where track j has not yet finished the Pattern and there is a remainder as mentioned above. When the remainder terminates, the content of the current-track-clock register CTCLKj of track j equals that of track-clock register TCLKj. The CPU 15 determines this at step SF11, and proceeds to step SF15 through steps SF12 to SF14, and then to step SF16 if the pending flag PENDj is "1". At step SF16, the CPU 15 sets the starting address of the Note-data area of track j of the current Pattern designated at step SF24 to pointer register PNTj, and Duration of the Note data to EVTDURj register Furthermore, the CPU 15 computes the track clock of the new Pattern and stores it to the TCLKk resister. After this, the CPU 15 resets the pending flag PENDj to "0" and proceeds to step SF19 described above. Thus, the next step of track j begins with a short delay from other tracks.

When step SF26 is completed, or the test result at step SF19 is negative, i.e., when the Pattern is not yet finished, the CPU 15 exits the routine and returns to step SE2 mentioned above. In the course of the routine, as described above, tone generation based on Pattern data is carried on.

Referring to FIG. 12 again, from step SC3 to SC10, Group-Level data are written into the Level-data area shown in FIG. 5C. First, at step SC3, the CPU 15 tests whether one or more of four continuous sliders CS1 to CS4 are operated or not. If the test result is positive, the CPU 15 proceeds to step SC4 and stores the number k of the operated one to k-register. At the next step SC5, a value indicated by continuous slider CSk is determined and stored to the Group-Level-data area indicated by the Group-Level-pointer register GRLPNTk. At the same time, the content of GRLDURk register, i.e., the duration of the previous level, is also stored thereto.

After that, the register GRLPNTk is incremented at step SC6 and the Group-Level-duration-measurement register GRLDURk is cleared to zero at step SC7. Subsequently, at step SC8, the value of the continuous slider CSk is stored to Group-Level register GRLk and the CPU 15 proceeds to LEVEL CONTROL ROUTINE at step SC9.

Figure 16:
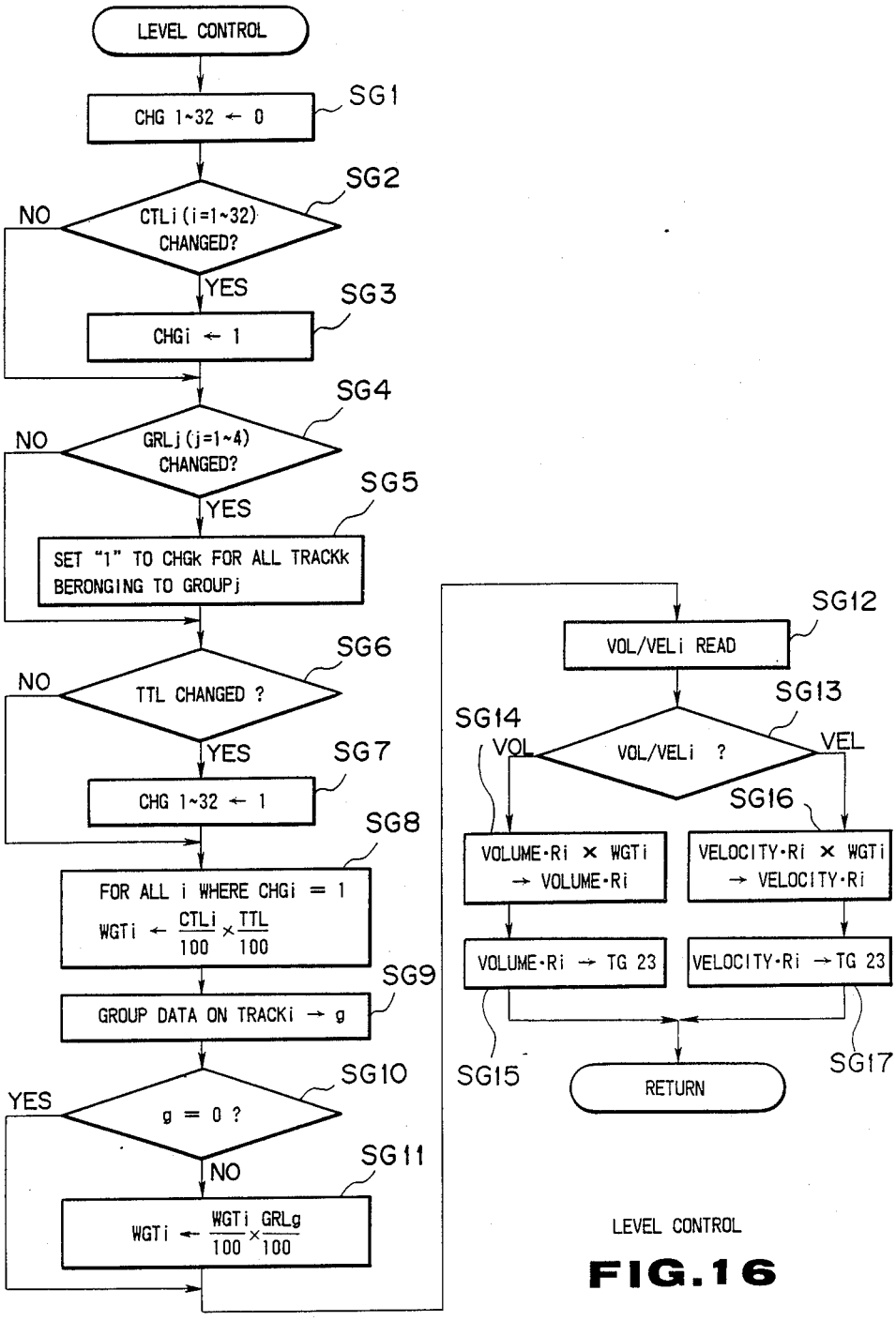
FIG. 16 is a flowchart of LEVEL CONTROL ROUTINE.

FIG. 16 is a flowchart of the LEVEL CONTROL ROUTINE. This routine tests changes in Track-Level data, Group-Level data and Total level data, then determines weight data WGTi for each track i. Moreover, the routine computes Volume and Velocity data, supplying them to the tone generator 23.

First, at step SG1, change table CHG is cleared. The change table CHG has 32 locations, CHG1 to CHG32, to indicate presence ("1") or absence ("0") of level change in each track. At step SG2, the CPU 15 tests current-Track-Level register CTLi to check the level change in track i (i=1 to 32). The register CTLi contains a value transferred from the continuous slider CS1 in Song Play and Level Record 2 mode described later. If one or more registers CTLi have changed, the CHGi in change table CHG are set to "1" at step SG3.

At step SG4 level change in Group-Level data is tested by checking changes in Group-Level register GRLj (see step SC8 in FIG. 12). If level change occurs in group j, all tracks k belonging to group j are marked by setting "1" to all CHGk associated with tracks k (step SG5).

At step SG6, level change in Total-Level data is tested by checking changes in Total-Level register TTL. If the Total Level changes, all CHG1 to 32 is set to "1" at step SG7.

After this, weight WGTi is computed. At step SG8, for all i where CHGi=1, the weight WGTi is computed as follows:

$$WGTi=(CTLi/100)\times(TTL/100)$$

Next, for each i mentioned above, Group data g is checked to see whether track i belongs to any group or not (step SG9 and SG10). If track i belongs to one of four groups, i.e., Group data g is not zero, the old WGTi is modified as follows at step SG11:

$$new\ WGTi=old\ WGTi\times(GRLg/100)$$

The two equations above mean that three kinds of level data are multiplied to obtain weight data WGTi.

The weight data WGTi is used to modify the Volume or Velocity data. First, at step SG12, Vol/Vel data is read out from Track-data area shown in FIG. 5A, and tested whether it designates Vol ("1") or Vel ("0") at step SG13. In the case where the Vol/Vel data indicates Vol, Volume data contained in VOLUME.Ri is multiplied by WGTi and the resulting product is loaded to the VOLUME.Ri at step SG14 and transferred to the tone generator 23 at step SG15. On the other hand, in the case where the Vol/Vel data indicate the Vel, Velocity data contained in VELOCITY.Ri is multiplied by WGTi and the resulting product is loaded to the VELOCITY.Ri at step SG16 and transferred to the tone generator 23 at step SG17. Thus, Volume and Velocity data which are modified by Track-Level data, Group-Level data and Total-Level data (in this case by Group-Level data only), are supplied to the tone generator 23, changing the volume of a Song being replayed as the performer desires. After this, the CPU 15 exits LEVEL CONTROL ROUTINE and returns to step SC10 in FIG. 12.

Referring again to FIG. 12, weight data WGT1 to WGT32 are displayed on the screen of DSP13 as shown in FIG. 7B. Thus, the writing of Group-Level data is achieved, varying the volume of the Song being played in real time.

From step SC11 to SC17, Total-Level data is written to the Level-data area shown in FIG. 5C just as Group-Level data are. First, the CPU 15 tests whether continuous slider CS5 is operated. If not, it transfers its control to step SC18. Conversely, if the test result is positive, the CPU 15 proceeds to step SC12 where it reads a value indicated by continuous slider CS5 and transfers it to the Total-Level-data area indicated by the Total-Level-pointer register TTLPNT. At the same time, the duration of the previous level contained in Total-Level-duration-measurement TTLDUR register is also transferred.

After that, the register TTLPNT is incremented at step SC13 and the register TTLDUR is cleared to zero at step SC14. Furthermore, at step SC8, the value of the continuous slider CS5 is stored to Total Level register TTL and the CPU 15 proceeds to. LEVEL CONTROL ROUTINE at step SC16. In this routine, Volume and Velocity data which are modified by Track-Level data, Group-Level data and Total-Level data (in this case by Total-Level data only), are supplied to the tone generator 23, changing the volume of a Song being replayed as the performer desires. After this, the CPU 15 exits LEVEL CONTROL ROUTINE and returns to step SC17 in FIG. 12.

Referring again to FIG. 12, the weight data WGT1 to WGT32 are displayed on the screen of DSP13 as shown in FIG. 7B. Thus, the writing of Total-Level data is achieved, varying the volume of a Song being played in real time.

At step SC18, the CPU 15 determines if it reaches the END in the Song data area. If the test result is negative, it turns control to step SC3 and repeats the process described above. On the other hand, if the test result is positive, the CPU 15 terminates the Song Play and Level Record mode 1.

(4) SONG PLAY AND LEVEL RECORD 2

In this process, Song data are read out sequentially and played back. At the same time, Track-Level data is written into the data area thereof shown in FIG. 5C. The process is carried out as follows:

(A) Initial Setting

SEQ on: a performer turns on the SEQ switch provided at keyboard portion.

DSP1: DSP1 screen shown in FIG. 7B appears.

DIR on: the performer presses a directory switch to select Song No.

DSP2: when the directory switch is turned on, DSP1 changes to DSP2 where Song Numbers and Song Names appear.

CURSOR: the performer operates cursor switches 9 or 10 to move the cursor for selection of a desired Song No.

OK on: after selection of Song No., the performer depresses OK switch (multifunction switch M6 in FIG. 1). The Song No. selected is stored in CPU 15.

DSP1: when the OK switch is pressed, DSP1 appears again to display the Song No. and the Song Name selected above.

REC on: the performer presses REC switch (multifunction switch M3) to enter into the recording mode for Level data.

DSP3: when the REC switch is depressed, the screen changes to DSP3 where the Song No. and Song Name is shown.

SONG: the performer depresses Song switch (multifunction switch M2) to enter into the Song mode.

DSP11: when the Song switch is pressed, DSP11 appears.

PAT on: the performer depresses PAT switch (M1 switch).

DSP14: when the PAT switch is depressed, DSP14 appears where the Track Level can be set.

Thus, the initial setting for Song Play and Level Record mode 2 is completed.

(B) Song Play and Level Data Write 2

Figure 17:
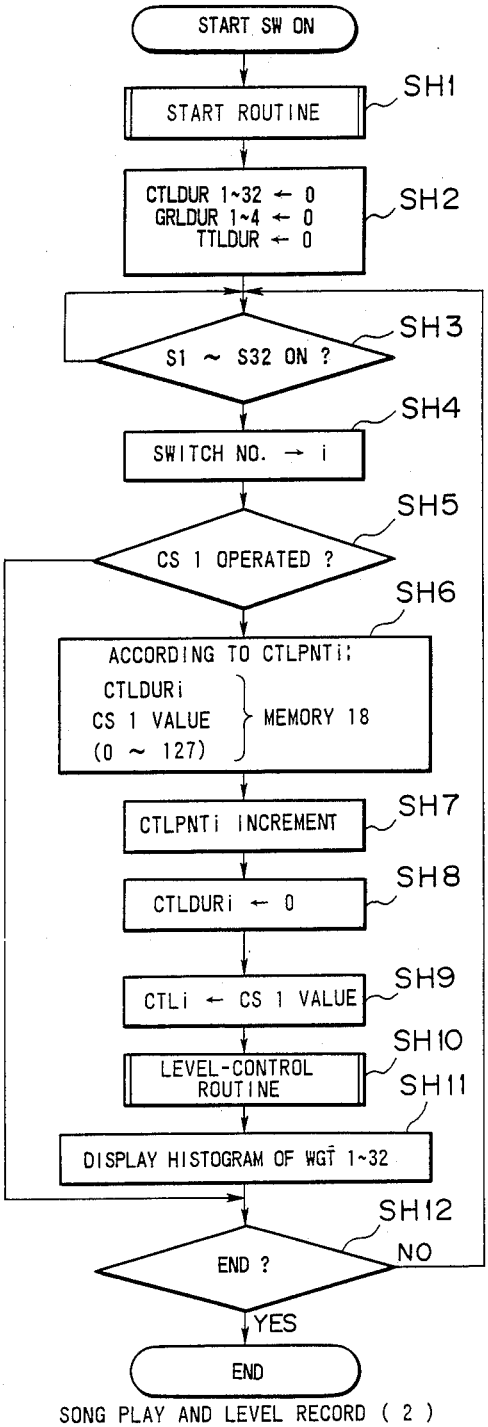
FIG. 17 is a flowchart showing the process of Song Play and Level Record 2.

FIG. 17 is a flowchart showing the process of Song Play and Level Write 2. In this process, the Track-Level data shown in FIG. 5C, are set in the Level-data area in the sequence memory 18. Track-Level data consist of Duration and Current Level data as shown in FIG. 5C.

When the START switch is turned on while displaying DSP14, the START ROUTINE is performed at step SH1. In this routine, the initial data for Song play and Level Write are set to the appropriate registers, as described previously in FIG. 13, and then the program returns to the mainline in FIG. 17.

At step SH2 in FIG. 17, three kinds of level-duration-measurement registers, i.e., current-Track-Level-duration-measurement registers CTLDUR 1 to 32, Group-Level-duration-measurement registers GRLDUR 1 to 4, and Total-Level-duration-measurement register TTLDUR, are all cleared to zero.

From the starting point of the process, i.e., after the START switch is turned on, every pulse of tempo clock TC from the tempo clock generator 19 (see FIG. 1) causes an interrupt in the CPU 15. When the interrupt occurs, the CPU 15 proceeds to the INTERRUPT ROUTINE shown in FIG. 14, and jumps to EVENT READ ROUTINE shown in FIG. 15 where it supplies data required to play Songs to the tone generator 23 (step SE1). After finishing the EVENT READ ROUTINE, the CPU 15 increments the three kinds of registers mentioned above to measure level durations for Level Record (step SE2), and returns to the mainline in FIG. 17.

In FIG. 17, from step SH3 to SH11, the Track-Level data are written into the Level-data area shown in FIG. 5C. First, at step SH3, the CPU 15 tests and waits until one of 32 switches 12 is depressed. If one of them is turned on, the switch No. i is set to the i-register as a track number at step SH4. After this, at step SH5, the CPU 15 tests whether continuous slider CS1 is operated or not. If not, the CPU 15 transfers its control to step SH12. On the other hand, if the test result is positive, the CPU 15 proceeds to step SH6 where the value determined by continuous slider CS1 is transferred to the Track-Level-data area indicated by the current Track-Level-pointer register CTLPNTi. At the same time, the content of current-Track-Level-duration-measurement register CTLDURi, i.e., the duration of the previous Track Level is also transferred thereto.

After that, the register CTLPNTi is incremented at step SH7 and the register CTLDURi is cleared to zero at step SH8. Subsequently, at step SH9, the value of continuous slider CS1 is stored to current Track-Level register CTLi, and the CPU 15 proceeds to the LEVEL CONTROL ROUTINE shown in FIG. 16 at step SH10. This routine tests changes in Track-Level data, Group-Level data and Total level data, then determines the weight data WGTi for each track i. Moreover, the routine modifies Volume and Velocity data by Track-Level data, Group-Level data and Total-Level data (in this case by Track-Level data only), and supplies them to the tone generator 23, changing the volume of a Song being replayed in response to changes of the continuous slider CS1. After this, the CPU 15 exits LEVEL CONTROL ROUTINE and returns to step SH11 in FIG. 17.

At step SH11, the weight data WGT1 to WGT32 are displayed on the screen of DSP14 as shown in FIG. 7B. Thus, the writing of Track-Level data is achieved, with varying the volume of a Song being played in real time At step SH12, the CPU 15 tests if it reaches the END in Song data area. If the test result is negative, it proceeds to step SH3 and repeats the process described above. On the other hand, if the test result is positive, the CPU 15 terminates the Song Play and Level Record mode 2.

(5) SONG AND LEVEL PLAY

In this process, Song data and Level data are read out sequentially and played back (A) Initial Setting SEQ on: a performer turns on the SEQ switch provided at keyboard portion.

DSP1: DSP1 screen shown in FIG. 7A appears.

DIR on: the performer presses a directory switch to select Song No.

DSP2: when the directory switch is turned on, DSP1 changes to DSP2 where Song Numbers and Song Names appear.

CURSOR: the performer operates cursor switches 9 or 10 to move the cursor for selection of a desired Song No.

OK on: after selection of Song No., the performer depresses OK switch (multifunction switch M6). Song No. selected is stored in CPU 15.

DSP1: when the OK switch is pressed, DSP1 appears again to display the Song No. and the Song Name selected above.

REC on: the performer presses REC switch to change the screen.

DSP3: when the REC switch is depressed, the screen changes to DSP3 where the Song No. and the Song Name are shown.

SONG: the performer depresses Song switch to enter into Song and Level Play mode.

DSP11: when the Song switch is pressed, DSP11 appears.

Thus, initial setting for Song and Level Play mode is completed.

(B) Song and Level Play

Figure 18B:
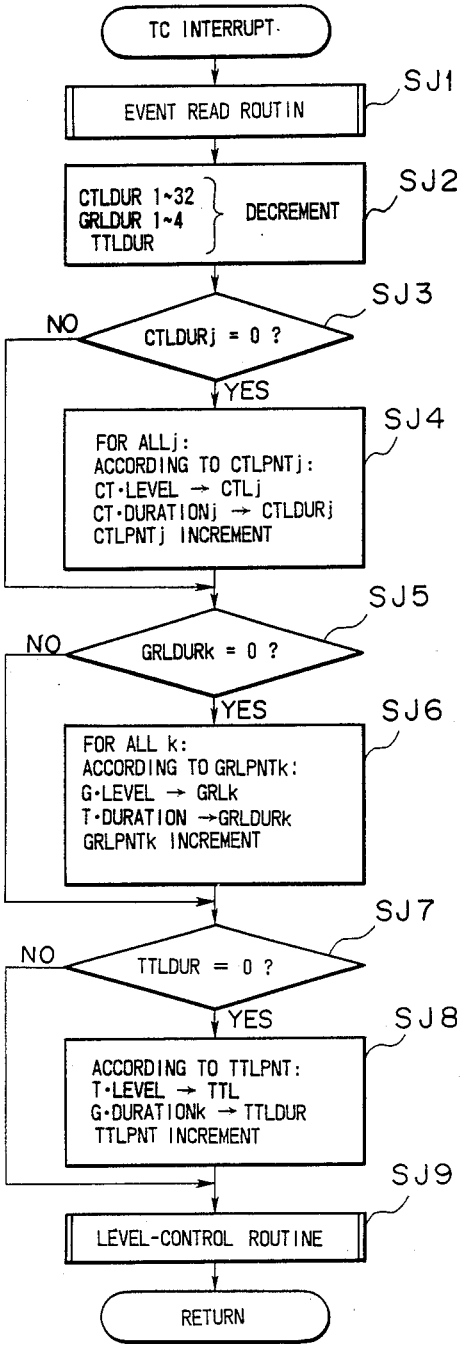
FIG. 18B is a flowchart of interrupt routine caused by tempo clock TC during Song and Level Play.
Figure 18A:
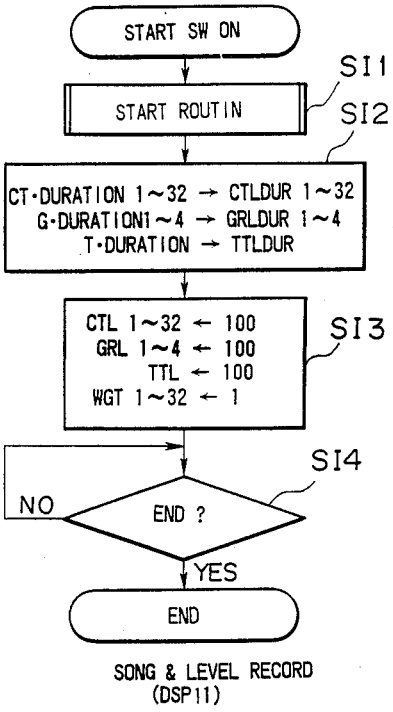
FIG. 18A is a flowchart showing the process of Song and Level Play.

FIG. 18A is a flowchart showing the process of Song and Level Play. In this process, Pattern data and Track-Level data shown in FIG. 5A and 5C are sequentially read out in accordance with Song data in FIG. 5B, and played back.

When the START switch is turned on while DSP11 is displayed, the START ROUTINE is performed at step SI1. In this routine, initial data for Song and Level Play are set to the appropriate registers as described before in reference to FIG. 13, and then returns to the mainline in FIG. 18A. At step SI2 in FIG. 18A, Duration of Track-Level data 1 to 32, Duration of Group-Level data 1 to 4, and Duration of Total-Level data are respectively set to current-Track-Level-duration-measurement register CTLDUR1 to 32, Group-Level-duration-measurement register GRLDUR1 to 4, and Total-Level-duration-measurement register TTLDUR. At step SI3, level registers and weight registers are initialized: "100" is set in current Track-Level registers CTL1 to CTL32, Group-Level registers GRL1 to GRL4 and a Total-Level register TTL, while "1" is set to weight registers WGT1 to WGT32. This is performed for normalizing these levels and weight.

From the starting point of the process, i.e., after the START switch is turned on, every pulse of tempo clock TC from the tempo clock generator 19 (see FIG. 1) causes interrupt to the CPU 15. When the interrupt occurs, the CPU 15 proceeds to INTERRUPT ROUTINE shown in FIG. 18B.

At step SJ1, in FIG. 18B, the CPU 15 jumps to EVENT READ ROUTINE shown in FIG. 15, where it supplies data concerning the Song and Levels to the tone generator 23. The tone generator 23 produces tone signals based on the data, and supplies them to the sound system where sounds are produced. After finishing the EVENT READ ROUTINE, the CPU 15 decrements three kinds of registers mentioned above to measure level durations for Level Play (step SJ2). Then, these level-duration-measurement registers are sequentially tested if they become zero, that is, if duration designated thereby are completed.

First, at step SJ3, current-Track-Level-duration-measurement registers CTLDUR1 to CTLDUR32 are tested. If one or more registers CTLDURj are zero, for all j that satisfy the condition, Track-Level data of track j are updated new Track-Level data are loaded to current-Track-Level registers CTLj, and the Duration thereof are loaded to current-Track-Level-duration-measurement registers CTLDURj. Furthermore, current-Track-Level-pointer registers CTLPNTj are incremented.

On the other hand, if none of the registers CTLDURj is zero, the CPU 15 proceeds to step SJ5 where a test is performed to determine whether Group-Level-duration-measurement registers GRLDURk (k=1 to 4) are zero. If one or more registers GRLDURj are zero, for all k that satisfy the condition, Group-Level data k are updated: new Group-Level data are loaded to Group-Level registers GRLk, and the Duration thereof are loaded to Group-Level-duration-measurement registers GRLDURk. Furthermore, Group-Level-pointer register GRLPNTk are incremented.

On the other hand, if none of the registers GRLDURk is zero, the CPU 15 proceeds to step SJ7 where test is performed whether Total-Level-duration-measurement register TTLDUR is zero. If the register TTLDUR is zero, it is updated: new Total-Level data is loaded to Total-Level registers TTL, and Duration thereof is loaded to Total-Level-duration-measurement register TTLDUR. Furthermore, Total-Level-pointer register TTLPNT is incremented. If the register TTLDUR is not zero, or step SJ8 is completed, the CPU 15 proceeds to step SJ9 and jumps to the LEVEL CONTROL ROUTINE in FIG. 16. This routine tests changes in Track-Level data, Group-Level data and Total level data, then, determines weight data WGTi for each track i. Moreover, the routine computes Volume and Velocity data, supplying them to the tone generator 23. Repeating the routine consecutively every time the interrupt occurs, the CPU 15 plays back a Song with volume control based on the Level data written in the manner described above.

After this, the CPU 15 transfers its control to step SI4, where it waits until the END of the Song data is detected.

(6) NEXT RECORD

In this process, Next data is written into the Next data area shown in FIG. 6A.

(A) Initial Setting

SEQ on: a performer turns on the SEQ switch provided at keyboard portion.

DSP1: DSP1 screen shown in FIG. 7A appears.

NEXT.R: the performer presses a NEXT.R switch to select NEXT function.

DSP15: when the NEXT.R switch is turned on, DSP1 changes to DSP15 where Next Record becomes possible.

Thus, the initial setting for Next is completed.

(B) Next Record

Figure 19:
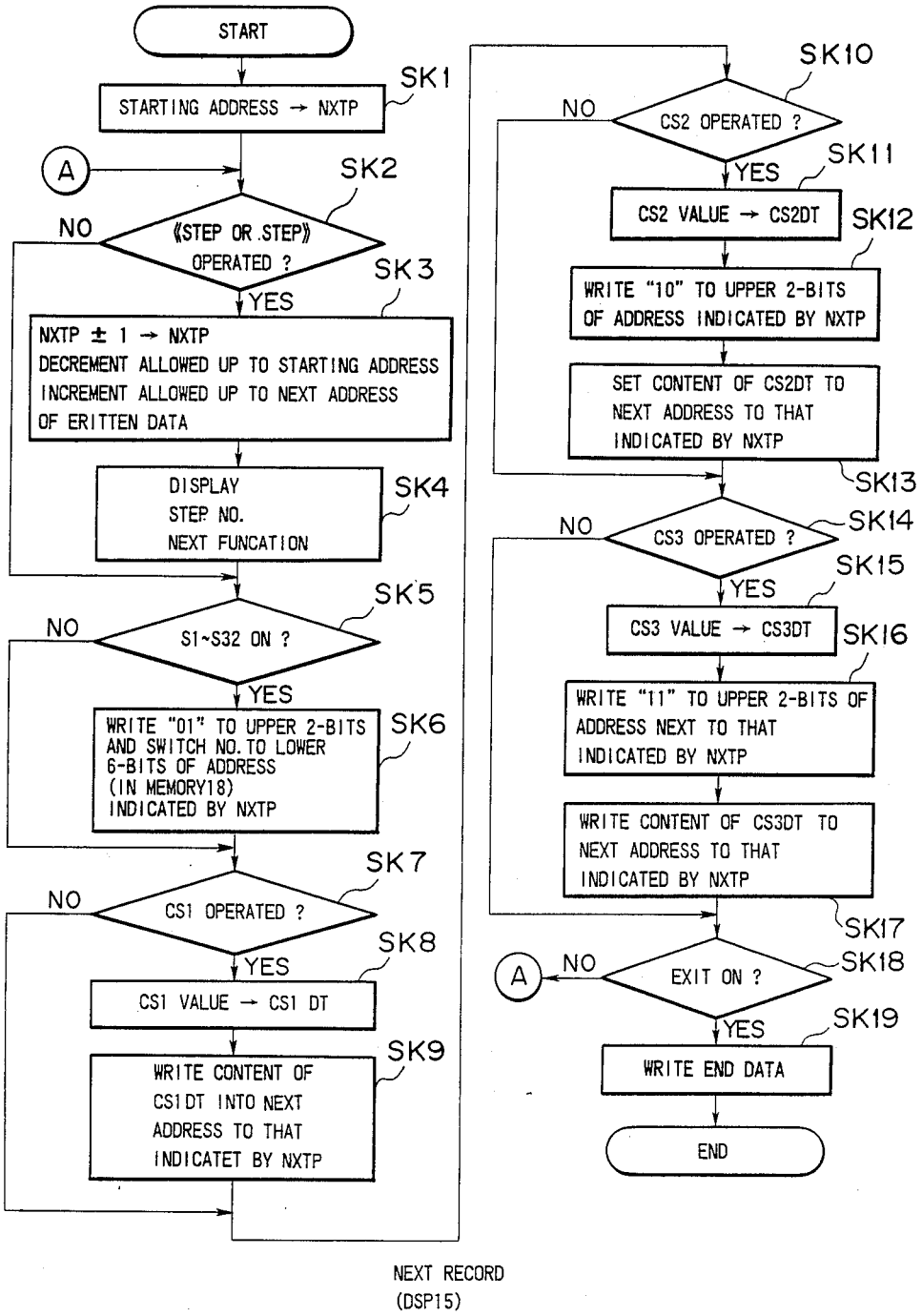
FIG. 19 is a flowchart showing the process of Next Recording.

FIG. 19 is a flowchart showing the process of Next Record. In this process, contents of a selected step Nxi in the Next-data area shown in FIG. 6A are set or changed. In other words, Step Number i is selected, and Next Functions of the step Nxi are written. The step number i is contained in a Next-pointer register NXTP. There are three items in the Next Functions: a Track No. and its tone color, a Combination Table No., and a Sequence of Song No.. One of these three items is written into step i selected above.

First, Next-pointer register NXTP is incremented or decremented by use of <<step or>> step switch (multifunction switch M1 or M2) to change an address of Nxi. Detecting the operation of the switch at step SK2, the CPU 15 proceeds to step SK3 where the pointer register NXTP is incremented or decremented in accordance with the operated switch. In this case, the decrement is allowed to the starting address of Next data area, while the increment is allowed up to the next address of written data. At step SK4, Step No. that the pointer register NXTP indicates, and the content of the step are displayed on DSP15.

From step SK5 to SK9, a Track No. and its tone color is written to a selected step. At step SK5, the CPU 15 tests whether one of 32-switches 12 is depressed. If the result is positive, the CPU 15 writes "01" to the upper 2-bits of the address indicated by the pointer register NXTP (see FIG. 6A), and the depressed switch No. to the lower 6-bits thereof (step SK6) After this, at step SK7, the CPU 15 tests if the continuous slider CS1 is operated. If so the CPU 15 sets a value determined by CS1 to CS1DT register at step SK8, then subsequently transfers the content of CS1DT register into the address next to that indicated by the pointer register NXTP at step SK9. Thus, a Track No. and its tone color is entered into Nxi, with the indication "01 ".

From step SK10 to SK13, a Combination Table No. is written into a step Nxi. An example of a Combination Table is shown in FIG. 6B. It is a table that contains 32-pairs of tracks and its respective tone-color code. There are many such Combination Tables in the sequence memory 18, and each of them has a table No. At step SK10, the CPU 15 tests if continuous slider CS2 is operated. If operated, the CPU 15 sets a value determined by CS2 to CS2DT register at step SK11, and transfers the content of CS2DT register into the address next to that indicated by the pointer register NXTP at step SK13, after writing "10" to the upper 2-bits of the address indicated by the pointer register NXTP at step SK12. Thus, a Combination Table No. is entered into Nxi with the indication "10 ".

From step SK14 to SK17, a Sequence No. is written into a step Nxi. The sequence No. designates a sequence in which songs are to be performed. At step SK14, the CPU 15 tests whether continuous slider CS3 is operated If operated, the CPU 15 sets a value determined by CS3 to CS3DT register at step SK15, and transfers the content of CS3DT register into the address next to that indicated by the pointer register NXTP at step SK17, after writing "11" to the upper 2-bits of the address indicated by the pointer register NXTP at step SK16. Thus, a Sequence No. is entered into Nxi with the indication of "11".

At step SK18, the CPU 15 tests if the EXIT switch is depressed. If it is depressed, the CPU 15 proceeds to step SK19 and writes END data to the address indicated by the pointer register NXTP, thus terminating the process. On the other hand, if it is not depressed, the CPU 15 repeats the process described above.

(7) NEXT

In this process, Next function is carried out: tone color or song No. can be changed immediately by one action.

(A) Initial Setting

SEQ on: a performer turns on the SEQ switch provided at keyboard portion.

DSP1: DSP1 screen shown in FIG. 7A appears.

NEXT: the performer presses a NEXT switch to change tone color or song No.

(B) Next Function

Figure 20:
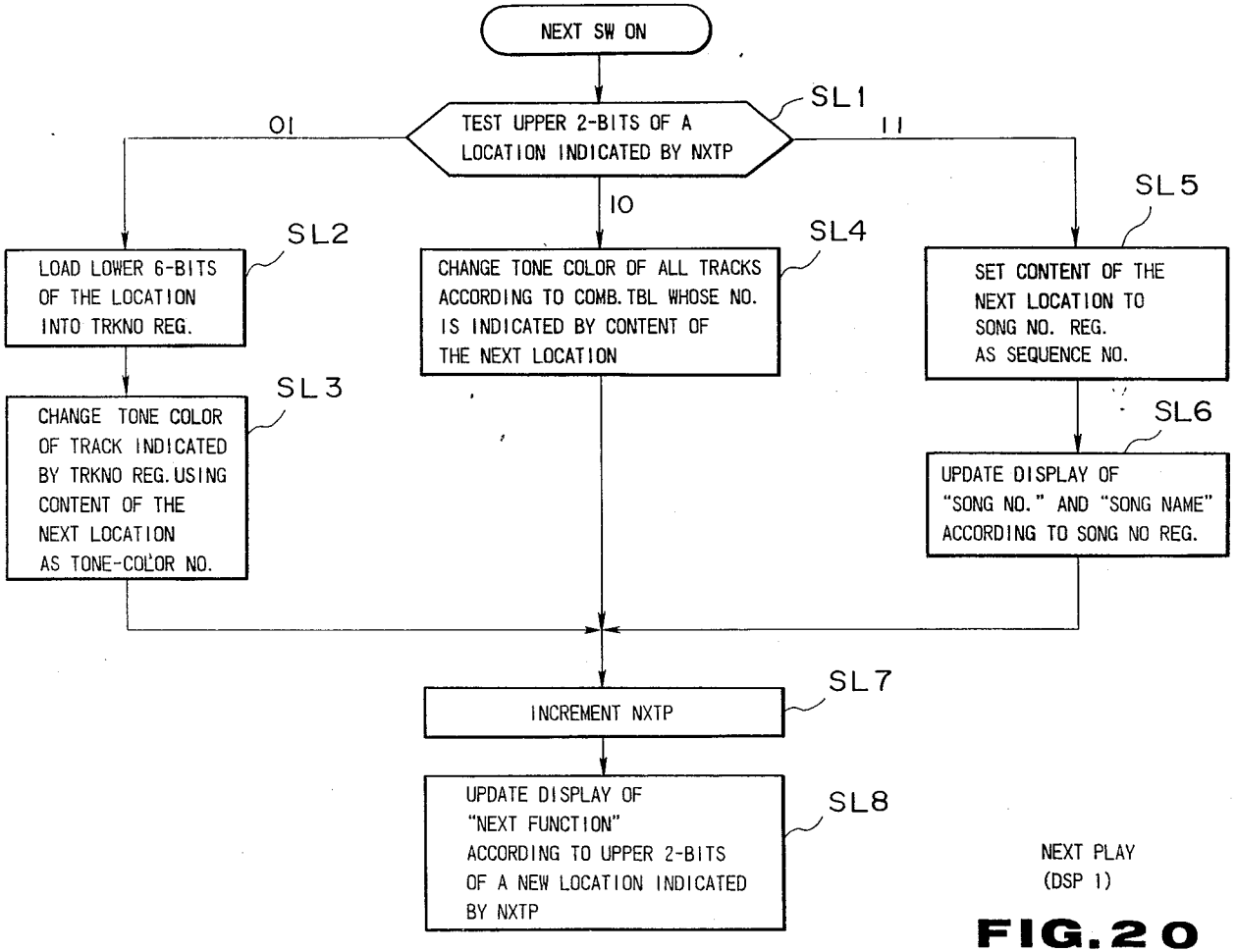
FIG. 20 is a flowchart showing the process of Next play.

FIG. 20 is a flowchart showing the process of Next. In this process, when the Next switch indicated by the screen DSP1 is pressed, current step in Next-data area in FIG. 6A is changed to its next step, and the contents thereof are read out to perform Song Play according to the read out data.

When the Next switch is pressed, the CPU 15 enters step SL1 and tests the upper 2-bits of the address indicated by the next-pointer register NXTP. If the 2-bits are "01", the CPU 15 proceeds to step SL2 and transfers the lower 6-bits of the address to track-number register TRKNO. At step SL3, the CPU 15 reads the content of the address next to that indicated by the pointer register NXTP, and changes the current tone color of the track designated by TRKNO register using the read data.

If the 2-bits are "10", the CPU 15 proceeds to step SL4 where it reads a Combination Table No. contained in the address next to that indicated by the pointer register NXTP, and determines a tone color of each track according to the Combination Table, thus changing the current tone colors of all the tracks by one action.

If the 2-bits are "11", the CPU 15 proceeds to step SL5 where it reads a Sequence No. contained in the address next to that indicated by pointer register NXTP, and sets the read data to a song-number register SONGNO, thus changing the current song to that designated by the Sequence No.. After this, the CPU 15 changes the Song No. and Song Name displayed on DSP1, at step SL6.

At step SL7, the CPU 15 increments the pointer register NXTP to designate the next step Nxi+1. In addition, at step SL8, it reads the upper 2-bits of the step Nxi+1 and displays a new Next Function according to the 2-bits, terminating the Next process.

Although a specific embodiment of a automatic musical performance apparatus constructed in accordance with the present invention has been disclosed, it is not intended that the invention be restricted to either the specific configurations or the uses disclosed herein. Modifications may be made in a manner obvious to those skilled in the art. Accordingly, it is intended that the invention be limited only by the scope of the appended claims.

What is claimed is:

1. An automatic musical performance apparatus comprising:

primary memory means for recording performance data, said primary memory means having a plurality of tracks containing pattern data;

secondary memory means for recording performance data, said secondary memory means having a plurality of tracks containing level data indicative of tone volumes of said tracks of the primary memory means;

data read means for reading data in said tracks of the primary and secondary memory means;

tone generating means for generating musical tones in accordance with data supplied from said data read means; and volume control means for controlling tone volumes of said tone generating means according to said level data.

2. An automatic musical performance apparatus of claim 1 wherein said primary and secondary memory means have the same number of tracks, and each of said tracks in said secondary memory means contains level data relating to each corresponding track of said primary memory means.

3. An automatic musical performance apparatus of claim 1 further comprising pattern data input means for entering pattern data, and pattern data write means for writing pattern data supplied from said pattern data input means to said tracks of said primary memory means.

4. An automatic musical performance apparatus of claim 1 further comprising level data input means for entering level data, and level data write means for writing level data supplied from said level data input means to said tracks of said secondary memory means while said tone generating means is generating musical tones in accordance with said pattern data, and said volume control means is controlling tone volumes of said tone generating means according to said written level data.

5. An automatic musical performance apparatus of claim 3 wherein said pattern data input means consists of a keyboard.

6. An automatic musical performance apparatus of claim 4 wherein said level data input means comprises switching means for selecting a track, variable resistor means for setting value of said level data, and display means indicating value set by said variable resistor means 7. An automatic musical performance apparatus of claim 1 further comprising song data memory means for storing song data that designate a sequence of said pattern data, said data read means reading out said pattern data according to said song data and supplying read out pattern data to said tone generating means.

8. An automatic musical performance apparatus of claim 7 further comprising song data setting means for entering said song data into said song data memory means.

9. An automatic musical performance apparatus of claim 8 wherein said song data setting means comprises variable resistor means for setting number of said pattern data, and display means indicating value set by said variable resistor means.

10. An automatic musical performance apparatus comprising:

primary memory means for recording performance data, said primary memory means having a plurality of tracks containing pattern data having level scale data and velocity data, said level scale data indicating tone volume of said pattern data, said velocity data indicating key velocity of each tone in said pattern data;

secondary memory means for recording performance data, said secondary memory means having a plurality of tracks containing level data indicative of tone volumes of said tracks of the primary memory means;

selecting means for selecting either said level scale data or velocity data as selected data to be controlled by said level data, according to volume/-velocity data included in each said track in said primary memory said volume/velocity data representing one of said level scale data and said velocity data;

data read means for reading data in said tracks of primary and secondary memory means;

tone generating means for generating musical tones in accordance with data supplied from said data read means; and volume control means for controlling tone volumes of said tone generating means according to said selected data modified by said level data.

11. An automatic musical performance apparatus of claim 10 wherein said volume control means modifies said selected data by multiplying said selected data by said level data.

12. An automatic musical performance apparatus of claim 10 further comprising pattern setting means for setting said pattern data including level scale data and velocity data into said primary memory means.

13. An automatic musical performance apparatus of claim 10 further comprising level setting means for setting said level data into said secondary memory means while said tone generating means generates musical tones according to said pattern data, and said volume control means controls tone volume of said musical tones according to current level data set by said level setting means.

14. An automatic musical performance apparatus of claim 10 further comprising song data memory means for storing song data that designate a sequence of said pattern data, whereby said data read means reads out said pattern data and supplying read out pattern data to said tone generating means.

15. An automatic musical performance apparatus comprising:

primary memory means for recording performance data, said primary memory means having a plurality of tracks containing pattern data;

designating means for dividing said tracks into one or more groups and assigning identical group level data to said tracks in the same group;

group level data memory means for storing said group level data;

data read means for reading data in said tracks of primary memory means and said group level data in said group level data memory means;

tone generating means for generating musical tones in accordance with data supplied from said data read means; and volume control means for controlling tone volumes of said tone generating means according to weight data obtained from said group level data.

16. An automatic musical performance apparatus of claim 15 further comprising setting means for setting said group and group level data.

17. An automatic musical performance apparatus of claim 16 wherein said tone generating means generates musical tones in accordance with said pattern data, and said volume control means controls tone volumes of said tone generating means according to the current group level data entered by use of said setting means.

18. An automatic musical performance apparatus of claim 16 wherein said setting means comprises switching means for selecting a track to be assigned to a group, variable resistor means for setting value of said group level data, and display means indicating value set by said variable resistor means.

19. An automatic musical performance apparatus of claim 15 further comprising secondary memory means having a plurality of tracks containing track level data indicative of tone volumes of said tracks of said primary memory means, said volume control means computes weight data by multiplying said track level data by group level data.

20. An automatic musical performance apparatus of claim 15 further comprising total level memory means for storing total level data that uniformly varies tone volumes of all tracks

21. An automatic musical performance apparatus of claim 20 further comprising setting means for setting said total level data

22. An automatic musical performance apparatus of claim 20 further comprising secondary memory means having a plurality of tracks containing track level data indicative of tone volumes of said tracks of said primary memory means, said volume control means computes weight data as a product of any two or more level data among said track level data, said group level data and said total level data.

23. An automatic musical performance apparatus comprising:

primary memory means for recording performance data, said primary memory means having a plurality of tracks containing pattern data, said pattern data including track data capable of having different loop length data and rhythm parameters depending on tracks, said track data being repeated with said loop length;

song data memory means for storing song data including a sequence and repetition times of said pattern data;

data read means for reading said pattern data in each track independently of the other tracks according to said song data; and tone generating means for generating musical tones in accordance with data supplied from said data read means.

24. An automatic musical performance apparatus of claim 23 further comprising setting means for setting said pattern data including track data having different loop lengths and/or rhythm parameters.

25. An automatic musical performance apparatus of claim 24 wherein said setting means comprises switching means for selecting a track to which said track data be entered, variable resistor means for setting value of said loop length and/or rhythm parameters and display means indicating value set by said variable resistor means.

26. An automatic musical performance apparatus of claim 23 wherein said loop length of each track is designated by the number of bars.

27. An automatic musical performance apparatus of claim 23 wherein said rhythm parameters are time.

28. An automatic musical performance apparatus of claim 23 further comprising secondary memory means having a plurality of tracks containing level data indicative of tone volumes of said tracks of the primary memory means, and volume control means for controlling tone volumes of said tone generating means according to said level data.

29. An automatic musical performance apparatus comprising:

primary memory means for recording performance data, said primary memory means having a plurality of tracks containing pattern data;

song data memory means for storing plural song data in a predetermined order, said song data indicating a tone color characteristic sequence and repetition times of said pattern data;

next data memory means for storing next data relating to a selection playback of said pattern data according to said song data;

switching means for switching said next data;

data read means for reading said pattern data according to said song data;

tone generating means for generating musical tones in accordance with data supplied from said data read means; and control means for controlling said data read means and/or said tone generating means according to said next data chosen by said switching means.

30. An automatic musical performance apparatus of claim 29 wherein said next data indicate a tone color of one of said tracks.

31. An automatic musical performance apparatus of claim 29 wherein said next data indicate one of combination tables, each of said combination tables designates a tone color of each of said tracks.

32. An automatic musical performance apparatus of claim 29 wherein said next data indicate one of said song data.

33. An automatic musical performance apparatus of claim 29 further comprising setting means for setting said next data to said next data memory means.

34. An automatic musical performance apparatus of claim 29 further comprising secondary memory means having a plurality of tracks containing level data indicative of tone volumes of said tracks of the primary memory means, and volume control means for controlling tone volumes of said tone generating means according to said level data.

* * * * *